US011735115B2

(12) United States Patent
Liu et al.

(10) Patent No.: US 11,735,115 B2
(45) Date of Patent: Aug. 22, 2023

(54) PIXEL DRIVING CIRCUIT HAVING TWO DATA SIGNALS TO COMPENSATE FOR THRESHOLD VOLTAGE AND DRIVING METHOD

(71) Applicant: BOE TECHNOLOGY GROUP CO., LTD., Beijing (CN)

(72) Inventors: Dongni Liu, Beijing (CN); Minghua Xuan, Beijing (CN); Xiaochuan Chen, Beijing (CN); Xue Dong, Beijing (CN); Haoliang Zheng, Beijing (CN); Han Yue, Beijing (CN); Ning Cong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/839,178

(22) Filed: Jun. 13, 2022

(65) Prior Publication Data

US 2022/0310018 A1 Sep. 29, 2022

Related U.S. Application Data

(63) Continuation of application No. 17/294,231, filed as application No. PCT/CN2020/119367 on Sep. 30, 2020, now Pat. No. 11,386,846.

(30) Foreign Application Priority Data

Nov. 1, 2019 (CN) ..... 201911061511.3

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC ..... G09G 3/3258
(Continued)

(56) References Cited

U.S. PATENT DOCUMENTS

2005/0156832 A1 7/2005 Ono
2006/0125741 A1 6/2006 Tanaka et al.
(Continued)

FOREIGN PATENT DOCUMENTS

CN 102314829 A 1/2012
CN 106504705 A 3/2017
(Continued)

OTHER PUBLICATIONS

International Search Report and Written Opinion of International Application No. PCT/CN2020/119367 issued by the Chinese Patent Office dated Dec. 30, 2020.
(Continued)

*Primary Examiner* — Long D Pham
(74) *Attorney, Agent, or Firm* — IP & T Group LLP

(57) ABSTRACT

A pixel driving circuit includes a data writing sub-circuit, a driving sub-circuit, and a control sub-circuit. The data writing sub-circuit is configured to: in response to a first scanning signal and a third scanning signal, write a first data signal into the driving sub-circuit; and in response to a second scanning signal and the third scanning signal, write a second data signal into the driving sub-circuit. The control sub-circuit is configured to, in response to an enable signal, connect a driving transistor to a first power supply voltage signal terminal and an element to be driven. The driving sub-circuit is configured to: according to the first data signal
(Continued)

and a first power supply voltage signal, output a driving to signal; and according to the second data signal and the first power supply voltage signal, control an operating state of the element to be driven.

20 Claims, 12 Drawing Sheets

(52) U.S. Cl.
CPC ..... *G09G 2310/0278* (2013.01); *G09G 2310/061* (2013.01)

(58) Field of Classification Search
USPC ..... 345/204
See application file for complete search history.

(56) References Cited

U.S. PATENT DOCUMENTS

| | | | | |
|---|---|---|---|---|
| 2012/0001893 | A1 | 1/2012 | Jeong et al. | |
| 2012/0127220 | A1 | 5/2012 | Noguchi | |
| 2015/0002499 | A1 | 1/2015 | Kim et al. | |
| 2015/0130691 | A1* | 5/2015 | Jeon | G09G 3/3225 345/82 |
| 2016/0019835 | A1 | 1/2016 | Han | |
| 2017/0263187 | A1 | 9/2017 | Zhu et al. | |
| 2018/0301080 | A1 | 10/2018 | Shigeta et al. | |
| 2019/0035333 | A1 | 1/2019 | Chen et al. | |
| 2019/0066585 | A1 | 2/2019 | Han | |
| 2019/0066587 | A1* | 2/2019 | Han | H01L 27/1218 |
| 2019/0251905 | A1 | 8/2019 | Yang et al. | |
| 2021/0110770 | A1 | 4/2021 | Yang et al. | |
| 2021/0174736 | A1 | 6/2021 | Yang et al. | |
| 2021/0201760 | A1 | 7/2021 | Wang et al. | |
| 2021/0366364 | A1 | 11/2021 | Xuan et al. | |
| 2022/0005403 | A1 | 1/2022 | Yue et al. | |

FOREIGN PATENT DOCUMENTS

| | | | |
|---|---|---|---|
| CN | 107424570 | A | 12/2017 |
| CN | 107909967 | A | 4/2018 |
| CN | 108320700 | A | 7/2018 |
| CN | 108510946 | A | 9/2018 |
| CN | 108538241 | A | 9/2018 |
| CN | 108735143 | A | 11/2018 |
| CN | 108777132 | A | 11/2018 |
| CN | 109872676 | A | 6/2019 |
| CN | 109872680 | A | 6/2019 |
| CN | 109920371 | A | 6/2019 |
| CN | 110010057 | A | 7/2019 |
| CN | 110021263 | A | 7/2019 |
| KR | 20030044566 | A | 6/2003 |

OTHER PUBLICATIONS

The First Office Action of Priority Application No. CN 201911061511.3 issued by the Chinese Patent Office dated Oct. 9, 2021.

Notification to Grant Patent Right for Invention of Priority Application No. CN 201911061511.3 issued by the Chinese Patent Office dated Dec. 17, 2021.

Ex parte Quayle Office Action of U.S. Appl. No. 17/294,231 issued by the USPTO dated Dec. 13, 2021.

Notice of Allowance of U.S. Appl. No. 17/294,231 issued by the USPTO dated Mar. 11, 2022.

Corrected Notice of Allowance of U.S. Appl. No. 17/294,231 issued by the USPTO dated Mar. 23, 2022.

* cited by examiner

PIXEL DRIVING CIRCUIT HAVING TWO DATA SIGNALS TO COMPENSATE FOR THRESHOLD VOLTAGE AND DRIVING METHOD

CROSS-REFERENCE TO RELATED APPLICATIONS

This application is a continuation of U.S. Ser. No. 17/294,231, filed on May 14, 2021, which claims priority to International Patent Application No. PCT/CN2020/119367 filed on Sep. 30, 2020, which in turn claims priority to Chinese Patent Application No. 201911061511.3, filed on Nov. 1, 2019, which are incorporated herein by reference in their entirety.

TECHNICAL FIELD

The present disclosure relates to the field of display technologies, and in particular, to a pixel driving circuit and a driving method for the same, and a display device.

BACKGROUND

Compared to an organic light-emitting diode (OLED) display device, both a micro light-emitting diode (Micro LED) display device and a mini light-emitting diode (Mini LED) display device have a higher luminous efficiency and reliability, and a lower power consumption, which may become the mainstream of display products in the future. In both the Micro LED display device and the Mini LED display device, pixel driving circuits are used to drive LEDs to emit light, so as to realize display. Therefore, a structure of the pixel driving circuit is very important for ensuring the display effects of the Micro LED display device and the Mini LED display device.

SUMMARY

In one aspect, a pixel driving circuit is provided. The pixel driving circuit includes a data writing sub-circuit, a driving sub-circuit, and a control sub-circuit. The driving sub-circuit includes a driving transistor. The data writing sub-circuit is connected to a first scanning signal terminal, a second scanning signal terminal, a third scanning signal terminal, a first data signal terminal, a second data signal terminal, and the driving sub-circuit. The data writing sub-circuit is configured to: in response to a first scanning signal received from the first scanning signal terminal and a third scanning signal received from the third scanning signal terminal, write a first data signal provided from the first data signal terminal into the driving sub-circuit, and compensate for a threshold voltage of the driving transistor; and in response to a second scanning signal received from the second scanning signal terminal and the third scanning signal received from the third scanning signal terminal, write a second data signal provided from the second data signal terminal into the driving sub-circuit, and compensate for the threshold voltage of the driving transistor.

The control sub-circuit is connected to an enable signal terminal, a first power supply voltage signal terminal, the driving sub-circuit. The control sub-circuit is configured to be connected to an element to be driven. The control sub-circuit is configured to, in response to an enable signal received from the enable signal terminal, connect the first power supply voltage signal terminal to the driving transistor, and connect the driving transistor to the element to be driven.

The driving sub-circuit is further connected to the first power supply voltage signal terminal. The driving sub-circuit is configured to: according to the first data signal and a first power supply voltage signal provided from the first power supply voltage signal terminal, output a driving signal to the element to be driven, so as to drive the element to be driven to operate; and according to the second data signal and the first power supply voltage signal, control the element to be driven to be in an operating state or in a non-operating state. The driving transistor is configured to be turned on and in a saturation state according to the second data signal, or be turned off according to the second data signal.

In some embodiments, in a case where the driving transistor is configured to be turned on and in the saturation state according to the second data signal, the driving sub-circuit is configured to according to the second data signal and the first power supply voltage signal, control the element to be driven to be in an operating state or in a non-operating state includes: the driving sub-circuit is configured to receive the second data signal, communicate with the first power supply voltage signal terminal and the element to be driven through the control sub-circuit, and according to the second data signal and to the first power supply voltage signal, drive the element to be driven to operate.

In some embodiments, in a case where the driving transistor is configured to be turned on and in the saturation state according to the second data signal, an operating duration of the element to be driven that is driven by the driving sub-circuit according to the first data signal and the first power supply voltage signal is less than an operating duration of the element to be driven that is driven by the driving sub-circuit according to the second data signal and the first power supply voltage signal.

In some embodiments, a duration in which the data writing sub-circuit writes the first data signal into the driving sub-circuit and compensates for the threshold voltage of the driving transistor is equal to a duration in which the data writing sub-circuit writes the second data signal into the driving sub-circuit and compensates for the threshold voltage of the driving transistor.

In some embodiments, the driving sub-circuit further includes a capacitor. A gate of the driving transistor is connected to a node, a first electrode of the driving transistor is connected to the data writing sub-circuit and the control sub-circuit, and a second electrode of the driving transistor is connected to the data writing sub-circuit and the control sub-circuit. An end of the capacitor is connected to the node, and another end of the capacitor is connected to the first power supply voltage signal terminal.

In some embodiments, the data writing sub-circuit includes a first data writing sub-circuit and a second data writing sub-circuit. The first data writing sub-circuit is connected to the first scanning signal terminal, the third scanning signal terminal, the first data signal terminal, and the driving sub-circuit. The first data writing sub-circuit is configured to, in response to the first scanning signal and the third scanning signal that are received, write the first data signal into the driving sub-circuit, and compensate for the threshold voltage of the driving transistor. The second data writing sub-circuit is connected to the second scanning signal terminal, the third scanning signal terminal, the second data signal terminal, and the driving sub-circuit. The second data writing sub-circuit is configured to, in response to the second scanning signal and the third scanning signal that are received, write the second data signal to the driving sub-circuit, and compensate for the threshold voltage of the driving transistor.

In some embodiments, the first data writing sub-circuit includes a second transistor and a third transistor. A gate of the second transistor is connected to the first scanning signal terminal, a first electrode of the second transistor is connected to the first data signal terminal, and a second electrode of the second transistor is connected to the first electrode of the driving transistor. A gate of the third transistor is connected to the third scanning signal terminal, a first electrode of the third transistor is connected to the second electrode of the driving transistor, and a second electrode of the third transistor is connected to the node.

In some embodiments, the second data writing sub-circuit includes a fourth transistor and a third transistor. A gate of the fourth transistor is connected to the second scanning signal terminal, a first electrode of the fourth transistor is connected to the second data signal terminal, and a second electrode of the fourth transistor is connected to the first electrode of the driving transistor. A gate of the third transistor is connected to the third scanning signal terminal, a first electrode of the third transistor is connected to the second electrode of the driving transistor, and a second electrode of the third transistor is connected to the node.

In some embodiments, the control sub-circuit includes a fifth transistor and a sixth transistor. A gate of the fifth transistor is connected to the enable signal terminal, a first electrode of the fifth transistor is connected to the first power supply voltage signal terminal, and a second electrode of the fifth transistor is connected to the first electrode of the driving transistor. A gate of the sixth transistor is connected to the enable signal terminal, a first electrode of the sixth transistor is connected to the second electrode of the driving transistor, and a second electrode of the sixth transistor is configured to be connected to a first electrode of the element to be driven.

In some embodiments, the pixel driving circuit further includes a reset sub-circuit. The reset sub-circuit is connected to a first reset signal terminal, an initial voltage signal terminal and the driving sub-circuit. The reset sub-circuit is configured to, in response to a first reset signal received from the first reset signal terminal, transmit an initial voltage signal provided from the initial voltage signal terminal to the driving sub-circuit.

In some embodiments, the reset sub-circuit includes a seventh transistor. A gate of the seventh transistor is connected to the first reset signal terminal, a first electrode of the seventh transistor is connected to the initial voltage signal terminal, and a second electrode of the seventh transistor is connected to the driving sub-circuit.

In some embodiments, the reset sub-circuit is further connected to a second reset signal terminal. The reset sub-circuit is configured to be connected to the element to be driven. The reset sub-circuit is further configured to, in response to a second reset signal received from the second reset signal terminal, transmit the initial voltage signal to the element to be driven.

In yet another aspect, a display device is provided. The display device includes a display panel. The display panel includes a plurality of pixel driving circuits as described above and a plurality of elements to be driven. Each element to be driven is connected to a corresponding pixel driving circuit.

In yet another aspect, a driving method for the pixel driving circuit as described above is provided. The driving method for the pixel driving circuit includes the following steps. In a first phase, in response to the first scanning signal and the third scanning to signal that are received, the data writing sub-circuit writes the first data signal into the driving sub-circuit, and compensates for the threshold voltage of the driving transistor. In a second phase, in response to the enable signal that is received, the control sub-circuit connects the driving transistor to the first power supply voltage signal terminal, and connects the driving transistor to the element to be driven. According to the first data signal and the first power supply voltage signal, the driving sub-circuit outputs the driving signal to the element to be driven, so as to drive the element to be driven to operate. In a third phase, in response to the second scanning signal and the third scanning signal that are received, the data writing sub-circuit writes the second data signal into the driving sub-circuit, and compensates for the threshold voltage of the driving transistor. In a fourth phase, in response to the enable signal that is received, the control sub-circuit connects the driving transistor to the first power supply voltage signal terminal, and connects the driving transistor to the element to be driven. According to the second data signal and the first power supply voltage signal, the driving sub-circuit controls the element to be driven to be in the operating state or in the non-operating state. The second data signal is configured to cause the driving transistor to be turned on and in the saturation state, or cause the driving transistor to be turned off.

In some embodiments, a duration of the fourth phase is greater than a duration of the second phase.

In some embodiments, in a case where the second data signal is configured to cause the driving transistor to be turned on and in the saturation state, according to the second data signal and the first power supply voltage signal, controlling, by the driving sub-circuit, the element to be driven to be in the operating state or in the non-operating state includes: according to the second data signal and the first power supply voltage signal, driving, by the driving sub-circuit, the element to be driven to operate.

In some embodiments, in a case where the second data signal is configured to cause the driving transistor to be turned on and in the saturation state, an operating duration of the element to be driven that is driven by the driving sub-circuit according to the first data signal and the first power supply voltage signal is less than an operating duration of the element to be driven that is driven by the driving sub-circuit according to the second data signal and the first power supply voltage signal.

In some embodiments, a duration in which the data writing sub-circuit writes the first data signal into the driving sub-circuit and compensates for the threshold voltage of the driving transistor is equal to a duration in which the data writing sub-circuit writes the second data signal into the driving sub-circuit and compensates for the threshold voltage of the driving transistor.

In some embodiments, the pixel driving circuit further includes a reset sub-circuit, and the reset sub-circuit is connected to a first reset signal terminal, an initial voltage signal terminal, and the driving sub-circuit. Before the first phase, the driving method for the pixel driving circuit further includes: in a reset phase, in response to a first reset signal received from the first reset signal terminal, the reset sub-circuit transmitting an initial voltage signal provided from the initial voltage signal terminal to the driving sub-circuit.

In some embodiments, the reset sub-circuit is further connected to a second reset signal terminal and the element to be driven. The driving method for the pixel driving circuit further includes: in the reset phase, in response to a second reset signal received from the second reset signal terminal, the reset sub-circuit transmitting the initial voltage signal to the element to be driven.

BRIEF DESCRIPTION OF THE DRAWINGS

In order to describe technical solutions in some embodiments of the present disclosure or the prior art more clearly, the accompanying drawings to be used in the description of some embodiments of the present disclosure or the prior art will be introduced below briefly. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, but not limitations on an actual size of a product, an actual process of a method and an actual timing of a signal to which the embodiments of the present disclosure relate.

DETAILED DESCRIPTION

Figure 1A:
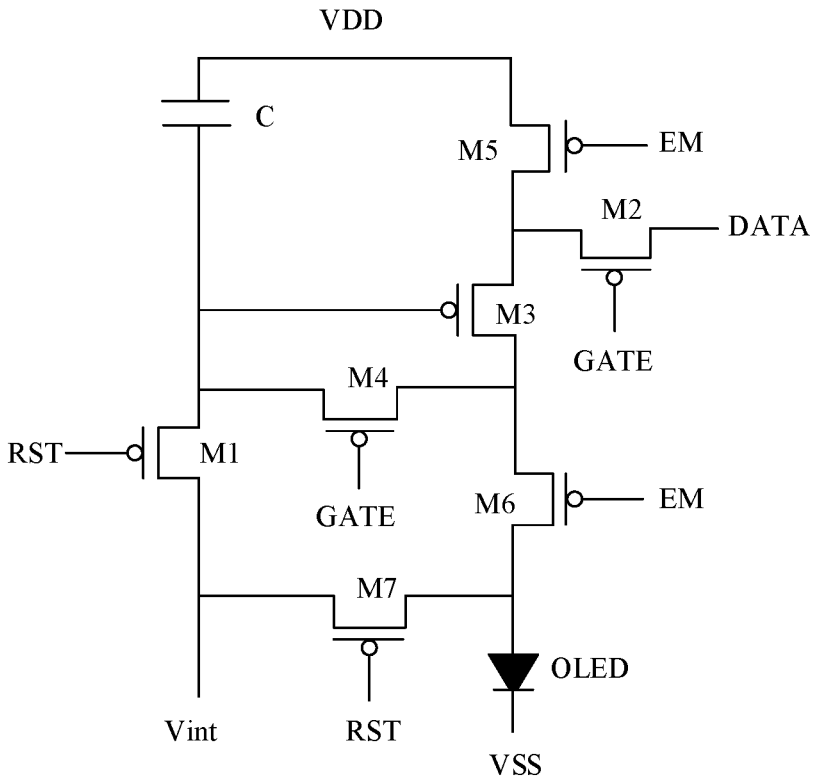
FIG. 1A (Prior Art)
FIG. 1A is a circuit configuration diagram of a pixel driving circuit for driving an OLED in the related art.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art on a basis of the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, terms such as "one embodiment," "some embodiments," "exemplary embodiments," "an example," "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Terms such as "first" and "second" are only used for descriptive purposes and are not to be construed as indicating or implying the relative importance or implicitly indicating the number of indicated technical features below. Thus, a feature defined by "first" or "second" may explicitly or implicitly include one or more of the features. In the description of the embodiments of the present disclosure, "a plurality of" or "the plurality of" means two or more unless otherwise specified.

In the description of some embodiments, "connected" and derivative expressions to thereof may be used. For example, the term "connected" may be used in the description of some embodiments to indicate that two or more components are in direct physical contact or electrical contact with each other. The embodiments disclosed herein are not necessarily limited to the content herein.

In the circuit provided from the embodiments of the present disclosure, the node does not represent an actual component, but represents a junction of related electrical connections in a circuit diagram. That is, the node is a point that is equivalent to the junction of the related electrical connections in the circuit diagram.

As used herein, the term "if" is, optionally, construed as "when" or "upon" or "in response to determining" or "in response to detecting", depending on the context.

The use of "configured to" herein means an open and inclusive expression, which does not exclude devices that are applicable to or configured to perform additional tasks or steps.

In addition, the use of "based on" means an open and inclusive expression, because a process, step, calculation or other actions that is "based on" one or more of the stated conditions may, in practice, be based on additional conditions.

The term "about" or "approximately" as used herein is inclusive of the stated value and an average value within an acceptable range of deviation for the particular value. The acceptable range of deviation is determined by a person of ordinary skill in the art considering the measurement in question and the error associated with measurement of the particular quantity (i.e., the limitations of the measurement system).

In the field of display technologies, light-emitting diode display devices have advantages of high brightness and wide color gamut, and thus will be more and more widely used in the display field in the future.

The light-emitting diode display device includes a display panel having a plurality of sub-pixel regions. A pixel driving circuit and an element to be driven connected to the pixel driving circuit are provided in each sub-pixel region. The element to be driven is, for example, a current light-emitting diode, such as a micro light-emitting diode (Micro LED), a mini light-emitting diode (Mini LED), or an organic light-emitting diode (OLED).

Figure 1B:
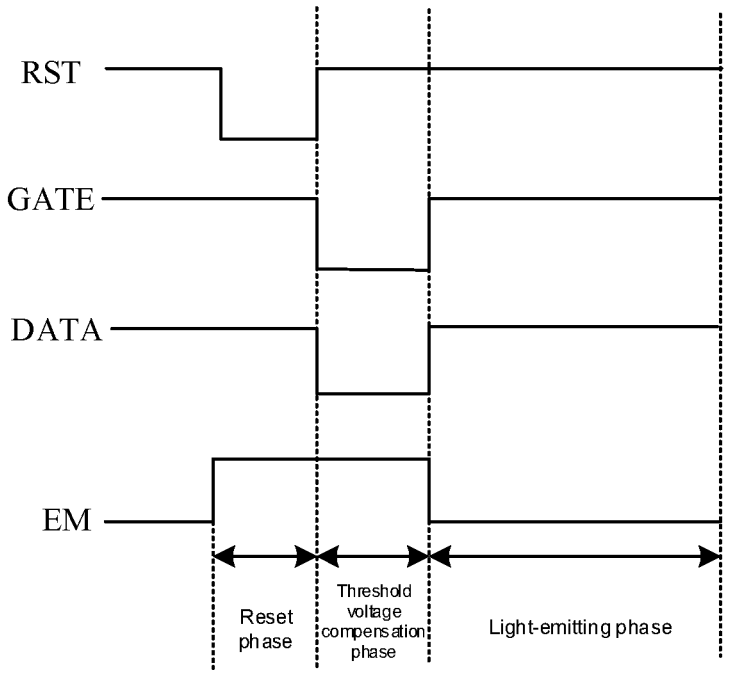
FIG. 1B (Prior Art)
FIG. 1B is a timing diagram of a pixel driving circuit for driving an OLED in the related art.

FIG. 1A is a circuit configuration diagram of a pixel driving circuit for driving an organic light-emitting diode (OLED) in the related art, and FIG. 1B is a timing diagram of the pixel driving circuit. Referring to FIGS. 1A and 1B, operating phases of the pixel driving circuit sequentially include a reset phase, a threshold voltage compensation phase, and a light-emitting phase. In the reset phase, in response to a reset signal received from a reset signal terminal RST, the pixel driving circuit transmits an initial voltage signal provided from an initial voltage signal terminal Vint to a transistor M3 and an anode of the OLED. The purpose of the reset is to eliminate data in a display of a previous frame, so as to avoid affecting a display of a current frame. In the threshold voltage compensation phase, in response to a scanning signal received from a scanning signal terminal GATE, the pixel driving circuit writes a data signal provided from a data signal terminal DATA and a threshold voltage of the transistor M3 into a gate of the transistor M3. In the light-emitting phase, in response to an enable signal received from an enable signal terminal EM, the pixel driving circuit connects a first electrode of the transistor M3 to a first power supply voltage signal terminal VDD, and connects a second electrode of the transistor M3 to the OLED. In this case, the transistor M3 outputs a driving signal (a driving current) to the OLED to make the OLED emit light, according to a first power supply voltage signal provided from the first power supply voltage signal terminal VDD and the data signal provided from the data signal terminal DATA.

In the above related art, a duration of the light-emitting phase is constant, and a brightness of the element to be driven is controlled by changing a magnitude of the driving current, thereby realizing a display of different gray scales. That is, during an entire light-emitting process of the OLED, the display of different gray scales is realized only by controlling the magnitude of the driving current. That is, when a high gray scale display is realized, a brightness of the OLED is increased by increasing the driving current input to the OLED. When a low gray scale display is realized, the brightness of the OLED is reduced by reducing the driving current input to the OLED.

In a case where the pixel driving circuit is configured to drive the Micro LED or the Mini LED to emit light, when the high gray scale display is realized, a large driving current is input to the Micro LED or the Mini LED, and the Micro LED or the Mini LED is at a high current density. When the low gray scale display is realized, a small driving current is input to the Micro LED or the Mini LED, and the Micro LED or the Mini LED is at a low current density.

Figure 2A:
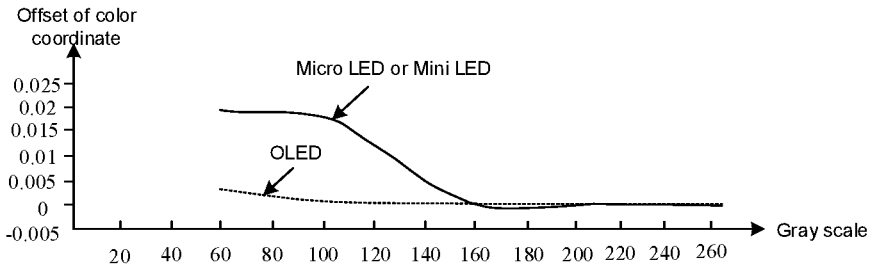
FIG. 2A is a diagram showing a relationship between a color coordinate and a gray scale of an OLED and a relationship between a color coordinate and a gray scale of a Micro LED or a Mini LED.
Figure 2B:
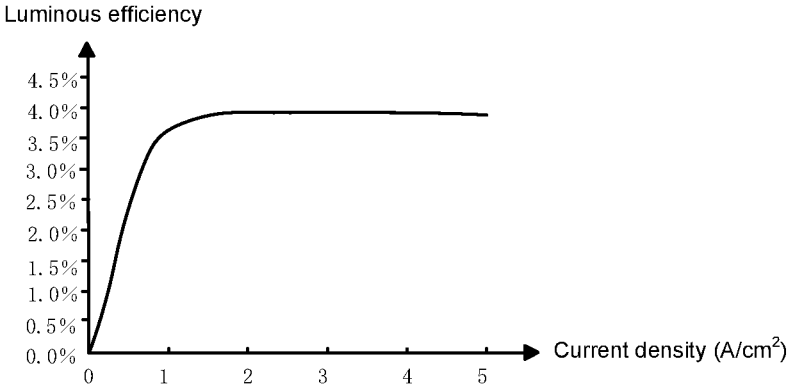
FIG. 2B is a diagram showing a relationship between a luminous efficiency and a current density when a Micro LED or a Mini LED emits red light.
Figure 2C:
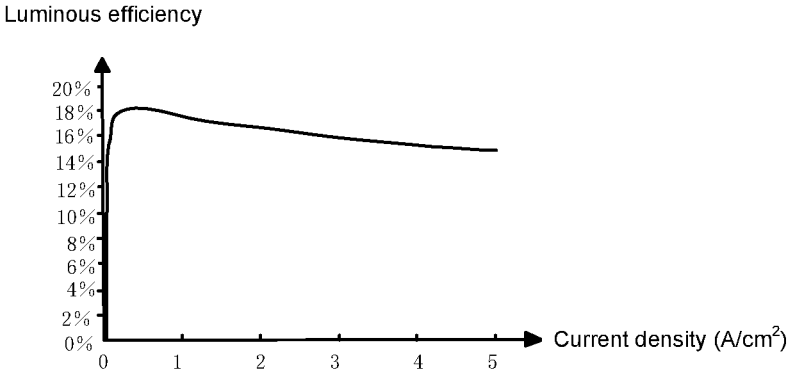
FIG. 2C is a diagram showing a relationship between a luminous efficiency and a current density when a Micro LED or a Mini LED emits green light.
Figure 2D:
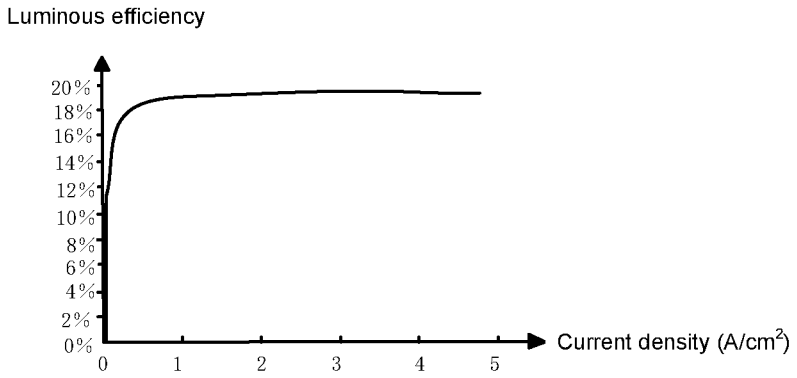
FIG. 2D is a diagram showing a relationship between a luminous efficiency and a current density when a Micro LED or a Mini LED emits blue light.

However, a luminous efficiency and a color coordinate of the Micro LED or the Mini LED are greatly affected by a current density. Taking the Micro LED as an example, as shown in FIG. 2A, when the Micro LED is at a low gray scale, that is, when the Micro LED is at a low current density, an offset of the color coordinate of the Micro LED is greater relative to an offset of the color coordinate of the OLED, and an influence on a display effect is greater. Micro LEDs have different luminous colors, and the current density has different influences on the luminous efficiency of the Micro LEDs. Hereinafter, the following description will be given by taking examples in which a Micro LED emits red light, green light, and blue light. As shown in FIG. 2B, when the Micro LED emits red light, the luminous efficiency of the Micro LED is 3.9%. In this case, the current density is approximately 1 A/cm$^2$. As shown in FIG. 2C, when the Micro LED emits green light, the luminous efficiency of the Micro LED is 18%. In this case, the current density is approximately 0.3 A/cm$^2$. As shown in FIG. 2D, when the Micro LED emits blue light, the to luminous efficiency of the Micro LED is 18%. In this case, the current density is approximately 0.6 A/cm$^2$. When the Micro LED displays a low gray scale, the current density of the Micro LED in the case where the Micro LED emits red light is usually below 0.5 A/cm$^2$, and the current densities in the cases where the Micro LED emits green light and blue light are usually approximately 0.1 A/cm$^2$. It can be seen from FIGS. 2B to 2D that whether the Micro LED emits red light, green light, or blue light, the current density is low when the Micro LED displays a low gray scale, so that the luminous efficiency of the Micro LED is low. Therefore, for the Micro LED, a low current density results in a low luminous efficiency when the Micro LED realizes the low gray scale display. The Mini LED has similar performances as the Micro LED. Therefore, for the Mini LED, a low current density also results in a low luminous efficiency when the Mini LED realizes the low gray scale display.

In summary, when the Micro LED or the Mini LED realizes the low gray scale display, a low current density results in a low luminous efficiency of the Micro LED or the Mini LED. The low luminous efficiency not only results in a high energy consumption, but also results in a gray scale less than a preset value during a display, so that the display brightness is low, and the display effect is poor. At a low current density, the less the gray scale is, the greater the offset of the color coordinate is, which results in a poor display effect of the Micro LED or the Mini LED.

Figure 3:
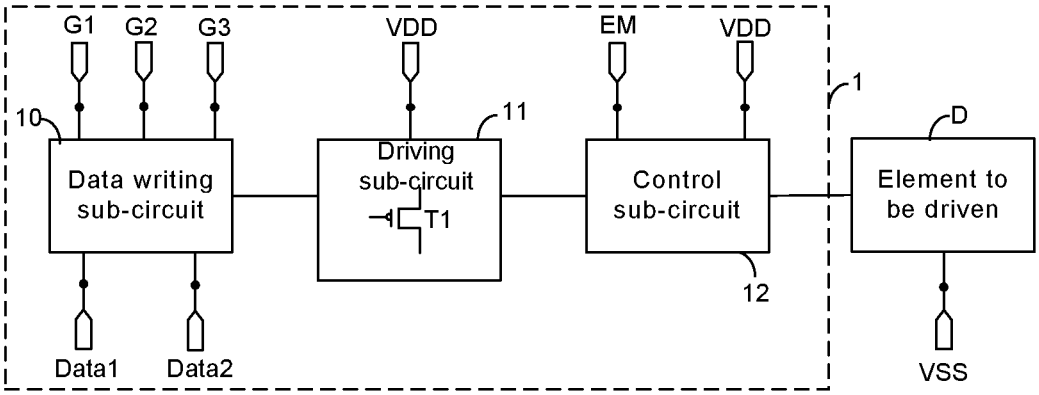
FIG. 3 is a block diagram showing a structure of a pixel driving circuit, in accordance with some embodiments of the present disclosure.

Based on this, some embodiments of the present disclosure provide a pixel driving circuit 1. As shown in FIG. 3, the pixel driving circuit 1 includes a data writing sub-circuit 10, a driving sub-circuit 11, and a control sub-circuit 12. The driving sub-circuit 11 includes a driving transistor T1.

The data writing sub-circuit 10 is connected to a first scanning signal terminal G1, a second scanning signal terminal G2, a third scanning signal terminal G3, a first data to signal terminal Data1, a second data signal terminal Data2, and the driving sub-circuit 11. The first scanning signal terminal G1 is configured to receive a first scanning signal and input the first scanning signal to the data writing sub-circuit 10. The second scanning signal terminal G2 is configured to receive a second scanning signal and input the second scanning signal to the data writing sub-circuit 10. The third scanning signal terminal G3 is configured to receive a third scanning signal and input the third scanning signal to the data writing sub-circuit 10. The first data signal terminal Data1 is configured to receive a first data signal and input the first data signal to the data writing sub-circuit 10. The second data signal terminal Data2 is configured to receive a second data signal and input the second data signal to the data writing sub-circuit 10.

The data writing sub-circuit 10 is configured to: in response to the first scanning signal received from the first scanning signal terminal G1 and the third scanning signal received from the third scanning signal terminal G3, write the first data signal provided from the first data signal terminal Data1 into the driving sub-circuit 11, and compensate fora threshold voltage of the driving transistor T1; and in response to the second scanning signal received from the second scanning signal terminal G2 and the third scanning signal received from the third scanning signal terminal G3, write the second data signal provided from the second data signal terminal Data2 into the driving sub-circuit 11, and compensate for the threshold voltage of the driving transistor T1.

The control sub-circuit 12 is connected to an enable signal terminal EM, a first power supply voltage signal terminal VDD, the driving sub-circuit 11, and an element to be driven D. The enable signal terminal EM is configured to receive an enable signal and input the enable signal to the control sub-circuit 12. The first power supply voltage signal terminal VDD is configured to receive a first power supply voltage signal and input the first power supply voltage signal to the control sub-circuit 12.

The control sub-circuit 12 is configured to, in response to the enable signal received from the enable signal terminal EM, connect the first power supply voltage signal terminal VDD to the driving transistor T1, and connect the driving transistor T1 to the element to be driven D.

In some embodiments, the control sub-circuit 12 is connected to a first electrode of the element to be driven D, and a second electrode of the element to be driven D is connected to a second power supply voltage signal terminal VSS.

In some examples, the first electrode and the second electrode of the element to be driven D are an anode and a cathode, respectively.

The driving sub-circuit 11 is further connected to the first power supply voltage signal terminal VDD. That is, the first power supply voltage signal terminal VDD also inputs the first power supply voltage signal to the driving sub-circuit 11.

It will be noted that the driving sub-circuit 11 is connected to the first power supply voltage signal terminal VDD, which excludes a case where the driving transistor T1 is directly connected to the first power supply voltage signal terminal VDD. In other words, the driving transistor T1 is electrically connected to the first power supply voltage signal terminal VDD through the control sub-circuit 12.

The driving sub-circuit 11 is configured to: according to the first data signal provided from the first data signal terminal Data1 and the first power supply voltage signal provided from the first power supply voltage signal terminal VDD, output a driving signal to the element to be driven D, so as to drive the element to be driven D to operate; and according to the second data signal provided from the second data signal terminal Data2 and the first power supply voltage signal provided from the first power supply voltage signal terminal VDD, control the element to be driven D to be in an operating state or in to a non-operating state.

An operating process of the pixel driving circuit 1 in some embodiments of the present disclosure includes a first phase to a fourth phase.

In the first phase, the data writing sub-circuit 10 writes the first data signal provided from the first data signal terminal Data1 into the driving sub-circuit 11, and compensates for the threshold voltage of the driving transistor T1. During this period, the driving transistor T1 and the element to be driven D are disconnected, and the driving transistor T1 and the first power supply voltage signal terminal VDD are disconnected. That is, the element to be driven D is in the non-operating state.

In the second phase, the control sub-circuit 12 connects the first power supply voltage signal terminal VDD to the driving transistor T1, and connects the driving transistor T1 to the element to be driven D. According to the first data signal provided from the first data signal terminal Data1 and the first power supply voltage signal provided from the first power supply voltage signal terminal VDD, the driving sub-circuit 11 outputs the driving signal to the element to be driven D, so as to drive the element to be driven D to operate.

In the third phase, the data writing sub-circuit 10 writes the second data signal provided from the second data signal terminal Data2 into the driving sub-circuit 11, and compensates for the threshold voltage of the driving transistor T1. During this period, the driving transistor T1 and the element to be driven D are disconnected, and the driving transistor T1 and the first power supply voltage signal terminal VDD are disconnected. That is, the element to be driven D is in the non-operating state again.

In the fourth phase, the control sub-circuit 12 connects the first power supply voltage signal terminal VDD to the driving transistor T1, and connects the driving transistor T1 to the element to be driven D again. According to the second data signal provided from the second data signal terminal Data2 and the first power supply voltage signal provided from the first power supply voltage signal terminal VDD, the driving sub-circuit 11 controls the element to be driven D to be in the operating state or in the non-operating state. In other words, if the second data signal and the first power supply voltage signal cannot turn on the driving transistor T1, the element to be driven D continues to be in the non-operating state of the third phase in the fourth phase. If the second data signal and the first power supply voltage signal turn on the driving transistor T1, the element to be driven D starts to operate again in the fourth phase.

It can be seen that an operating duration of the element to be driven D is determined by the second data signal provided from the second data signal terminal Data2 and the first power supply voltage signal provided from the first power supply voltage signal terminal VDD. In a case where the first power supply voltage signal is a constant direct current voltage signal, the operating duration of the element to be driven D is determined by the second data signal provided from the second data signal terminal Data2. In other words, if the element to be driven D is in the non-operating state in the fourth phase, a duration of the second phase is the operating duration of the element to be driven D. If the element to be driven D is in the operating state in the fourth phase, a sum of the duration of the second phase and a duration of the fourth phase is the operating duration of the element to be driven D.

In some embodiments of the present disclosure, the operation of the element to be driven D may be understood as a light emission of a current light-emitting diode. The element to be driven D in the operating state may be understood as the current light emitting-diode in a light-emitting state. The element to be driven D in the non-operating state may be understood as the current light-emitting diode in a non-light-emitting state. The driving sub-circuit 11 outputting the driving signal to drive the element to be driven D to operate may be understood as the driving sub-circuit 11 outputting a driving current to the current light-emitting diode to drive the current light-emitting diode to emit light. The operating duration of the element to be driven D may be understood as a light-emitting duration of the current light-emitting diode.

In some examples, the element to be driven D is a Micro LED or a Mini LED.

In the pixel driving circuit 1 in some embodiments of the present disclosure, in the first phase, the data writing sub-circuit 10 writes the first data signal provided from the first data signal terminal Data1 into the driving sub-circuit 11, and compensates for the threshold voltage of the driving transistor T1. In the third phase, the data writing sub-circuit 10 writes the second data signal provided from the second data signal terminal Data2 into the driving sub-circuit 11, and compensates for the threshold voltage of the driving transistor T1. In the second phase and in the fourth phase, the control sub-circuit 12 connects the first power supply voltage signal terminal VDD to the driving transistor T1, and connects the driving transistor T1 to the element to be driven D. In the second phase, according to the first data signal provided from the first data signal terminal Data1 and the first power supply voltage signal provided from the first power supply voltage signal terminal VDD, the driving sub-circuit 11 outputs the driving signal to the element to be driven D, so as to drive the element to be driven D to operate. In the fourth phase, according to the second data signal provided from the second data signal terminal Data2 and the first power supply voltage signal provided from the first power supply voltage signal terminal VDD, the driving sub-circuit 11 controls the element to be driven D to be in the operating state or in the non-operating state. The driving sub-circuit 11 controls the element to be driven D to be in the operating state or in the non-operating state in the fourth phase, which may change the operating duration of the element to be driven D. In this way, when the low gray scale display is realized, a brightness of the element to be to driven D is reduced by providing a large driving current and a short light-emitting duration (the duration of the second phase) to the element to be driven D. When the high gray scale display is realized, the brightness of the element to be driven D is improved by providing a large driving current and a long operating duration (the sum of the duration of the second phase and the duration of the fourth phase) to the element to be driven D. That is, during an entire gray scale display process, the driving current transmitted to the element to be driven D is always large, so that the element to be driven D is always at a high current density. In this way, the element to be driven D has a large luminous efficiency, a small color coordinate offset, a low energy consumption, and a good display effect.

Figure 7:
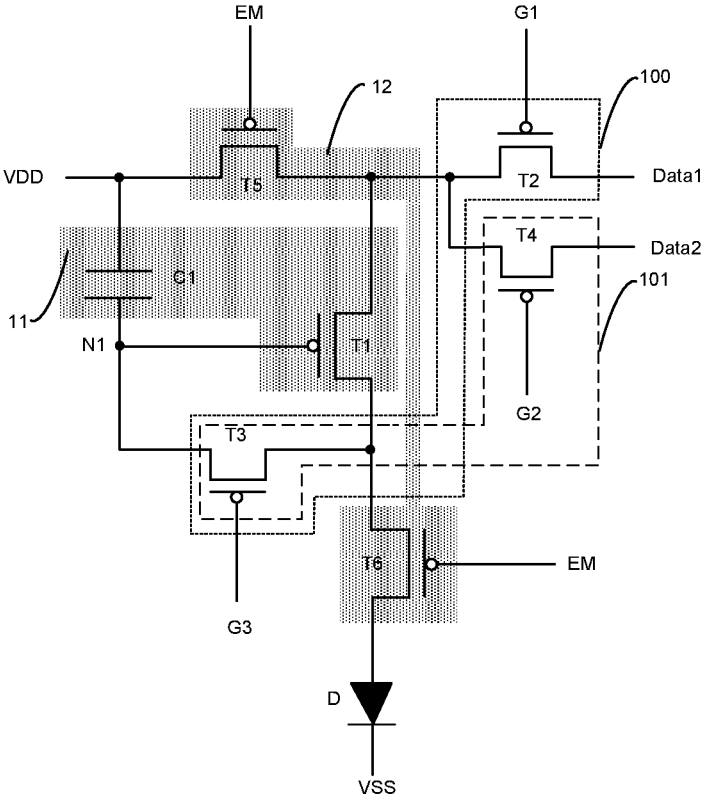
FIG. 7 is a circuit configuration diagram of a pixel driving circuit, in accordance with some embodiments of the present disclosure.
Figure 8:
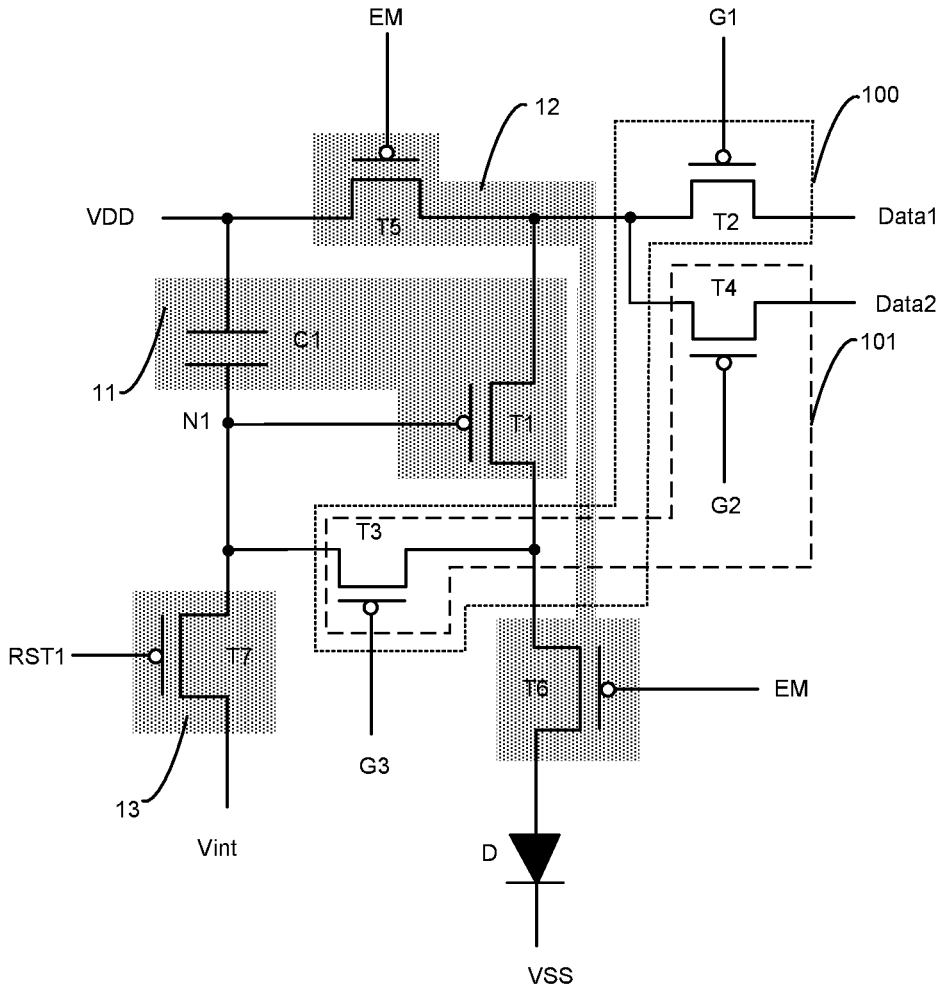
FIG. 8 is a circuit configuration diagram of another pixel driving circuit, in accordance with some embodiments of the present disclosure.
Figure 9:
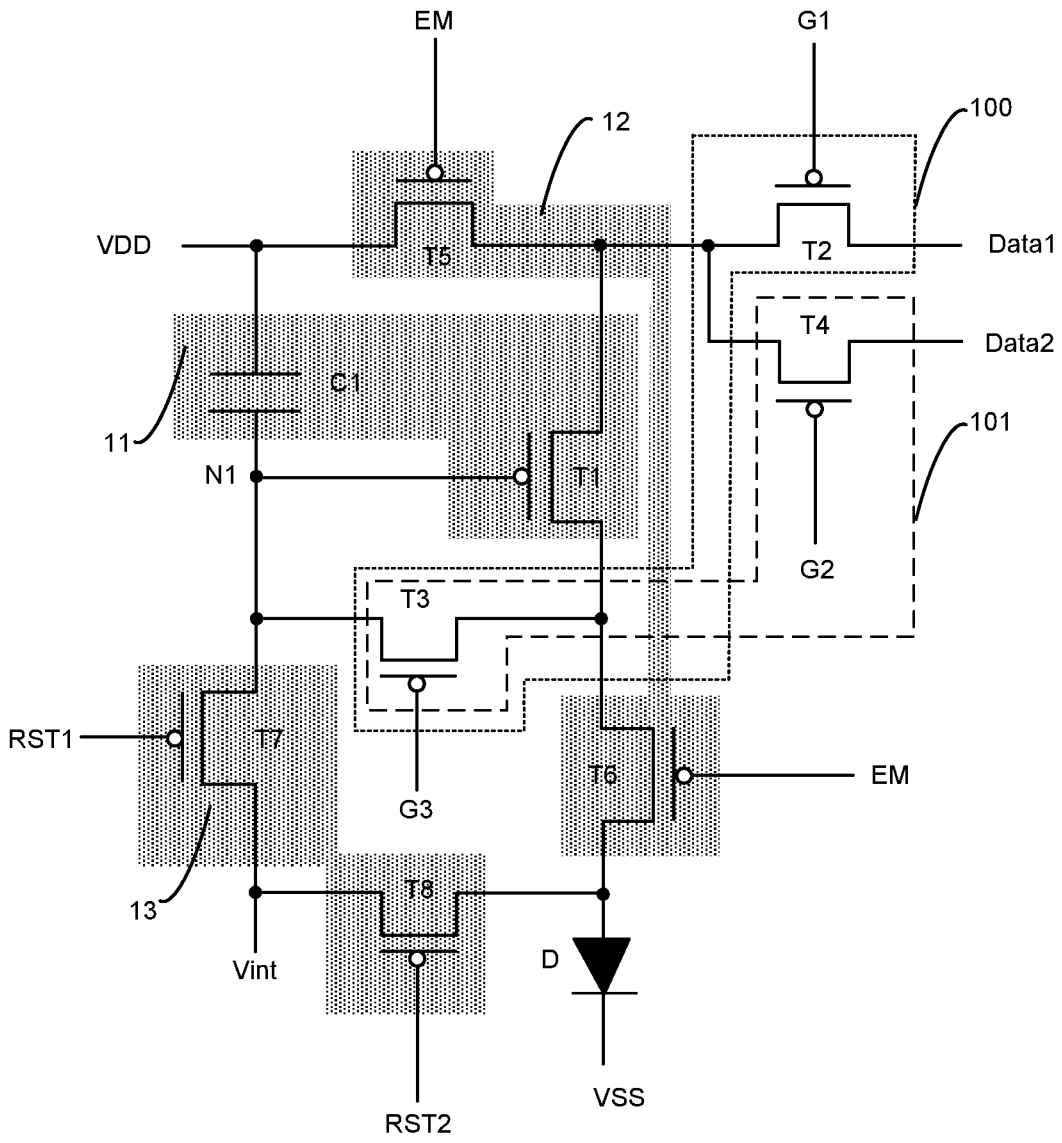
FIG. 9 is a circuit configuration diagram of yet another pixel driving circuit, in accordance with some embodiments of the present disclosure.

In some embodiments, as shown in FIGS. 7 to 9, the driving sub-circuit 11 includes the driving transistor T1 and a capacitor C1.

A gate of the driving transistor T1 is connected to a node N1, a first electrode of the driving transistor T1 is connected to the data writing sub-circuit 10 and the control sub-circuit 12, and a second electrode of the driving transistor T1 is connected to the data writing sub-circuit 10 and the control sub-circuit 12.

An end of the capacitor C1 is connected to the node N1, and another end of the capacitor C1 is connected to the first power supply voltage signal terminal VDD.

The capacitor C1 is configured to: in the first phase, receive and store the first data signal written by the data writing sub-circuit 10 and the threshold voltage of the driving transistor T1, and transmit the first data signal and the threshold voltage to the gate of the driving transistor T1; and in the third phase, receive and store the second data signal written by the data writing sub-circuit 10 and the threshold voltage of the driving transistor T1, and transmit the second data signal and the threshold voltage to the gate of the driving transistor T1.

The driving transistor T1 is configured to: output a driving signal in the second phase according to the first data signal stored in the capacitor C1 and the first power supply voltage signal provided from the first power supply voltage signal terminal VDD; and output a driving signal or not output the driving signal in the fourth phase according to the second data signal stored in the capacitor C1 and the first power supply voltage signal provided from the first power supply voltage signal terminal VDD.

Figure 4:
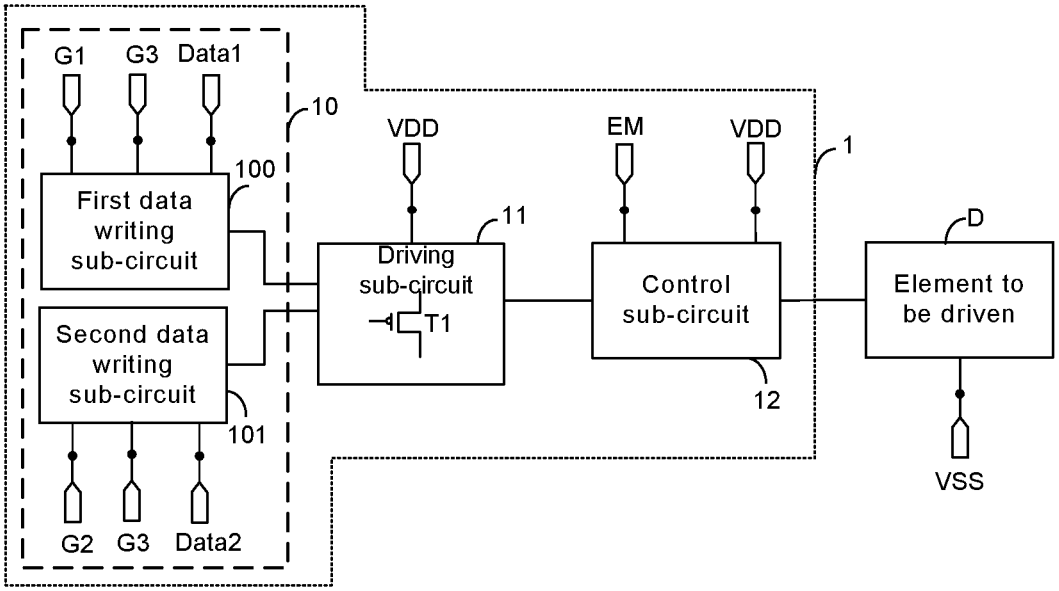
FIG. 4 is a block diagram showing a structure of another pixel driving circuit, in to accordance with some embodiments of the present disclosure.

In some embodiments, as shown in FIG. 4, the data writing sub-circuit 10 includes a first data writing sub-circuit 100 and a second data writing sub-circuit 101.

The first data writing sub-circuit 100 is connected to the first scanning signal terminal G1, the third scanning signal terminal G3, the first data signal terminal Data1, and the driving sub-circuit 11. The first data writing sub-circuit 100 is configured to: in the first phase, in response to the first scanning signal received from the first scanning signal terminal G1 and the third scanning signal received from the third scanning signal terminal G3, write the first data signal provided from the first data signal terminal Data1 into the driving sub-circuit 11, and compensate for the threshold voltage of the driving transistor T1.

In the first phase, the first data writing sub-circuit 100 writes the first data signal and the threshold voltage of the driving transistor T1 into the driving sub-circuit 11, which compensates for the threshold voltage of the driving transistor T1. In addition, in the second phase, when the first power supply voltage signal terminal VDD is connected to the driving transistor T1, and the driving transistor T1 is connected to the element to be driven D, the driving transistor T1 outputs the driving signal to the element to be driven D according to the first data signal and the first power supply voltage signal to drive the element to be driven D to operate.

The second data writing sub-circuit 101 is connected to the second scanning to signal terminal G2, the third scanning signal terminal G3, the second data signal terminal Data2, and the driving sub-circuit 11. The second data writing sub-circuit 101 is configured to: in the third phase, in response to the second scanning signal received from the second scanning signal terminal G2 and the third scanning signal received from the third scanning signal terminal G3, write the second data signal provided from the second data signal terminal Data2 into the driving sub-circuit 11, and compensate for the threshold voltage of the driving transistor T1.

In the third phase, the second data writing sub-circuit 101 writes the second data signal and the threshold voltage of the driving transistor T1 into the driving sub-circuit 11, which compensates for the threshold voltage of the driving transistor T1. In addition, in the fourth phase, when the first power supply voltage signal terminal VDD is connected to the driving transistor T1, and the driving transistor T1 is connected to the element to be driven D, the second data signal and the first power supply voltage signal may control the driving transistor T1 to be turned on, thereby outputting the driving signal to the element to be driven D, so as to drive the element to be driven D to operate. Or, the second data signal and the first power supply voltage signal cannot turn on the driving transistor T1, and the element to be driven D continues to be in the non-operating state.

In some examples, as shown in FIGS. 7 to 9, the first data writing sub-circuit 100 includes a second transistor T2 and a third transistor T3.

A gate of the second transistor T2 is connected to the first scanning signal terminal G1, a first electrode of the second transistor T2 is connected to the first data signal terminal Data1, and a second electrode of the second transistor T2 is connected to the first electrode of the driving transistor T1.

A gate of the third transistor T3 is connected to the third scanning signal terminal to G3, a first electrode of the third transistor T3 is connected to the second electrode of the driving transistor T1, and a second electrode of the third transistor T3 is connected to the node N1.

In the first phase, the second transistor T2 is configured to be turned on in response to the first scanning signal received from the first scanning signal terminal G1, so as to transmit the first data signal provided from the first data signal terminal Data1 to the first electrode of the driving transistor T1. The third transistor T3 is configured to be turned on in response to the third scanning signal received from the third scanning signal terminal G3, so that the second electrode of the driving transistor T1 and the gate of the driving transistor T1 are short-circuited, thereby allowing the driving transistor T1 to be in a saturation state. The first data signal and the threshold voltage (denoted as $V_{th}$) of the driving transistor T1 are transmitted to the node N1, and a voltage (denoted as $V_{Data1}$) of the node N1 is a sum of a voltage of the first data signal and the threshold voltage, i.e., ($V_{Data1}+V_{th}$).

In some examples, as shown in FIGS. 7 to 9, the second data writing sub-circuit 101 includes a fourth transistor T4 and a third transistor T3.

A gate of the fourth transistor T4 is connected to the second scanning signal terminal G2, a first electrode of the fourth transistor T4 is connected to the second data signal terminal Data2, and a second electrode of the fourth transistor T4 is connected to the first electrode of the driving transistor T1.

A gate of the third transistor T3 is connected to the third scanning signal terminal G3, a first electrode of the third transistor T3 is connected to the second electrode of the driving transistor T1, and a second electrode of the third transistor T3 is connected to the node N1.

In the third phase, the fourth transistor T4 is configured to be turned on in response to the second scanning signal received from the second scanning signal terminal G2, so as to transmit the second data signal provided from the second data signal terminal Data2 to the first electrode of the driving transistor T1. The third transistor T3 is configured to be turned on in response to the third scanning signal received from the third scanning signal terminal G3, so that the second electrode of the driving transistor T1 and the gate of the driving transistor T1 are short-circuited, thereby allowing the driving transistor T1 to be in the saturation state. The second data signal and the threshold voltage of the driving transistor T1 are transmitted to the node N1, and the voltage of the node N1 is a sum of a voltage (denoted as $V_{Data2}$) of the second data signal and the threshold voltage, i.e., ($V_{Data2}+V_{th}$).

Based on the above, since the third transistor T3 of the first data writing sub-circuit 100 has the same function as the third transistor T3 of the second data writing sub-circuit 101, the first data writing sub-circuit 100 and the second data writing sub-circuit 101 may share one third transistor T3. That is, the data writing sub-circuit 10 includes the second transistor T2, the third transistor T3, and the fourth transistor T4.

In some embodiments, as shown in FIGS. 7 to 9, the control sub-circuit 12 includes a fifth transistor T5 and a sixth transistor T6.

A gate of the fifth transistor T5 is connected to the enable signal terminal EM, a first electrode of the fifth transistor T5 is connected to the first power supply voltage signal terminal VDD, and a second electrode of the fifth transistor T5 is connected to the first electrode of the driving transistor T1.

A gate of the sixth transistor T6 is connected to the enable signal terminal EM, a first electrode of the sixth transistor T6 is connected to the second electrode of the driving transistor T1, and a second electrode of the sixth transistor T6 is connected to the first to electrode of the element to be driven D.

In the second phase and in the fourth phase, the fifth transistor T5 is configured to be turned on in response to the enable signal received from the enable signal terminal EM, so as to connect the first power supply voltage signal terminal VDD to the driving transistor T1. In the second phase and in the fourth phase, the sixth transistor T6 is configured to be turned on in response to the enable signal received from the enable signal terminal EM, so as to connect the driving transistor T1 to the element to be driven D.

In the pixel driving circuit 1, in the first phase, the first data writing sub-circuit 100 writes the first data signal provided from the first data signal terminal Data1 and the threshold voltage of the driving transistor T1 into the node N1, so that the voltage of the node N1 is ($V_{Data1}+V_{th}$). Since a gate voltage of the driving transistor T1 is equal to the voltage of the node N1, the gate voltage $V_g$ of the driving transistor T1 is equal to ($V_{Data1}+V_{th}$) (i.e., $V_g=V_{Data1}+V_{th}$).

In the second phase, in response to the enable signal received from the enable signal terminal EM, the control sub-circuit 12 connects the driving transistor T1 to the first power supply voltage signal terminal VDD, and connects the driving transistor T1 to the element to be driven D. Since the first electrode of the fifth transistor T5 is connected to the first power supply voltage signal terminal VDD, and the second electrode of the fifth transistor T5 is connected to the first electrode of the driving transistor T1, the first power supply voltage signal provided from the first power supply voltage signal terminal VDD is transmitted to the first electrode of the driving transistor T1, so that a voltage of the first electrode of the driving transistor T1 is a voltage (denoted as \ha) of the first power supply voltage signal. In this way, in an example where the driving transistor T1 is a P-type transistor, in a case where the gate voltage ($V_{Data1}+V_{th}$) of the driving transistor T1 and the voltage $V_{dd}$ of the first electrode of the driving transistor T1 satisfy a condition that $V_{Data1}+V_{th}-V_{dd}<V_{th}$, i.e., $V_{Data1}-V_{dd}<0$, the driving transistor T1 is turned on and outputs the driving signal, so that the element to be driven D emits light.

It can be seen that in the second phase, the turn-on of the driving transistor T1 is not affected by the threshold voltage of the driving transistor T1.

In the third phase, the second data writing sub-circuit 101 writes the second data signal provided from the second data signal terminal Data2 and the threshold voltage of the driving transistor T1 to the node N1, so that the voltage of the node N1 is ($V_{Data2}+V_{th}$). Since the gate voltage of the driving transistor T1 is equal to the voltage of the node N1, the gate voltage $V_g$ of the driving transistor T1 is equal to ($V_{Data2}+V_{th}$) (i.e., $V_g=V_{Data2}+V_{th}$).

In the fourth phase, in response to the enable signal received from the enable signal terminal EM again, the control sub-circuit 12 connects the driving transistor T1 to the first power supply voltage signal terminal VDD, and connects the driving transistor T1 to the element to be driven D. Similar to the second phase, the first power supply voltage signal provided from the first power supply voltage signal terminal VDD is transmitted to the first electrode of the driving transistor T1, so that the voltage of the first electrode of the driving transistor T1 is the voltage of the first power supply voltage signal. In this way, in an example where the driving transistor T1 is a P-type transistor, in a case where the gate voltage ($V_{Data2}+V_{th}$) of the driving transistor T1 and the voltage $V_{dd}$ of the first electrode of the driving transistor T1 satisfy a condition that ($V_{Data2}+V_{th}-V_{dd}<V_{th}$), i.e., $V_{Data2}-V_{dd}<0$, the driving transistor T1 is turned on and outputs the driving signal, so that the element to be driven D emits light. In a case where $V_{Data2}+V_{th}-V_{dd}\geq V_{th}$, i.e., $V_{Data2}-V_{dd}\geq 0$, the driving transistor T1 cannot be turned on, so that the element to be driven D continues to be in the non-operating state.

It can be seen that in the fourth phase, the turn-on of the driving transistor T1 is not affected by the threshold voltage of the driving transistor T1, and whether the driving transistor T1 is turned on or not is determined by $V_{Data2}$.

In a case where a high mobility thin film transistor (for example, a low temperature polysilicon thin film transistor) is used as the driving transistor, since the high mobility thin film transistor is affected by a manufacturing process, a threshold voltage thereof usually has a certain deviation from a design value, which affects an operating stability of this type of thin film transistor. Correspondingly, the driving signal is also be affected.

In the pixel driving circuit 1 in some embodiments of the present disclosure, since the threshold voltage of the driving transistor T1 is compensated both in the second phase and in the fourth phase, the driving signal output by the driving transistor T1 is unrelated to the threshold voltage of the driving transistor T1, which helps to ensure the operating stability of the driving transistor T1, and to improve the luminous efficiency, the brightness stability and the display effect of the element to be driven D. In addition, $V_{dd}$ may be designed as a constant value, so that the driving signal output by the driving transistor T1 may be controlled according to $V_{Data1}$ or $V_{Data2}$, and the control is simple and accurate.

For the pixel driving circuit in each sub-pixel region, in a case where the second data signal cannot turn on the driving transistor T1, that is, in a case where the element to be driven D is in the non-operating state in the fourth phase, in an image frame, the duration of the second phase is the operating duration of the element to be driven D, and this process is referred to as a short-scan operating mode. In a case where the second data signal may turn on the driving transistor T1, that is, in a case where the element to be driven D is in the operating state in the fourth phase, in an image frame, the sum of the duration of the second phase and the duration of the fourth phase is the operating duration of the element to be driven D, and this process is referred to as a long-scan operating mode. It can be seen that in the pixel driving circuit 1 in some embodiments of the present disclosure, the operating duration of the element to be driven D has two modes, i.e., the short-scan operating mode and the long-scan operating mode.

It will be noted that since the duration of the third phase is generally short (less than 42 ms), which cannot be recognized by human eyes, in the long-scan operating mode, human eyes will observe that the element to be driven D emits light from the second phase until the end of the fourth phase.

The pixel driving circuit 1 realizes the low gray scale display by controlling the magnitude of the driving current (the driving signal) input to the element to be driven D and combining the short-scan operating mode, and realizes the high gray scale display by controlling the magnitude of the driving current input to the element to be driven D and combining the long-scan operating mode.

In a case where the element to be driven D displays a high gray scale, the first data signal provided from the first data signal terminal Data1 may be a constant signal that enables the element to be driven D to have a high and stable luminous efficiency. In the long-scan operating mode, the voltage of the second data signal may vary within a certain voltage range, and the second data signal within the voltage range is able to ensure that the element to be driven D has a high luminous efficiency. In this case, the magnitude of the driving current may be controlled through the second data signal, so that the pixel driving circuit 1 controls the gray scales through the second data signal.

In a case where the element to be driven D displays a low gray scale, the voltage of the first data signal may vary within a certain voltage range, and the first data signal within the voltage range is able to ensure that the element to be driven D has a high luminous efficiency. In the short-scan operating mode, the second data signal may be a constant signal to control the driving transistor T1 not to be turned on. In this case, the magnitude of the driving current may be controlled through the first data signal, so that the pixel driving circuit 1 controls the gray scales through both the first data signal and the second data signal.

Figure 5:
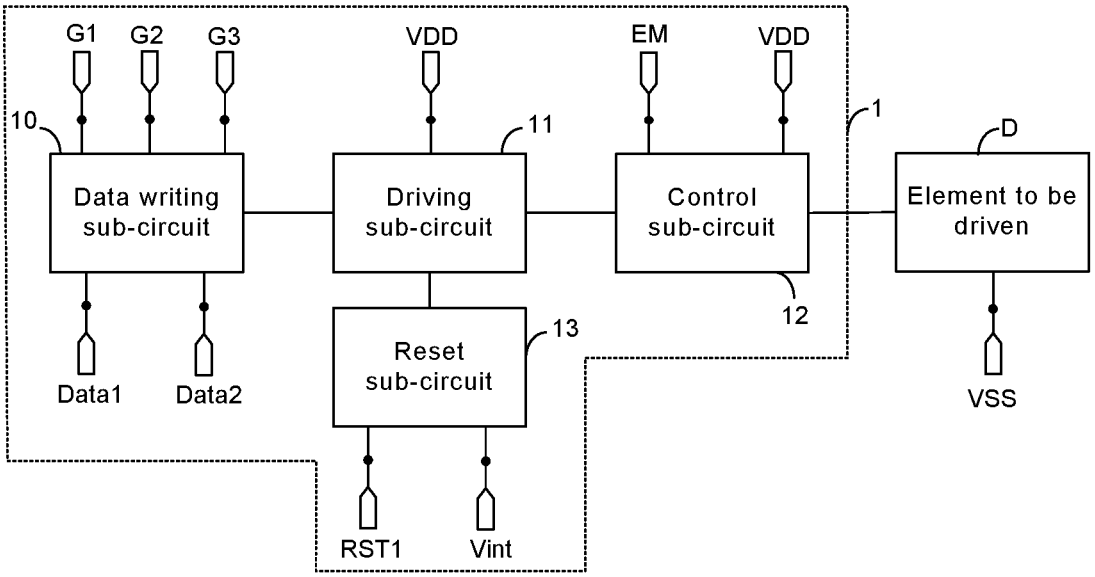
FIG. 5 is a block diagram showing a structure of yet another pixel driving circuit, in accordance with some embodiments of the present disclosure.
Figure 6:
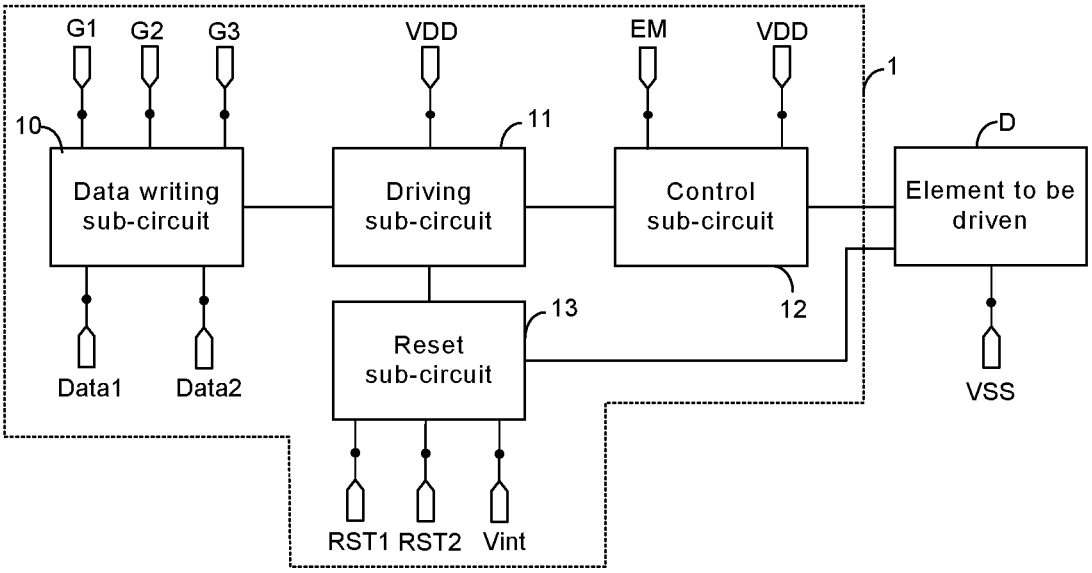
FIG. 6 is a block diagram showing a structure of yet another pixel driving circuit, in accordance with some embodiments of the present disclosure.

In some embodiments, as shown in FIGS. 5 and 6, the pixel driving circuit 1 further includes a reset sub-circuit 13. The reset sub-circuit 13 is connected to a first reset signal terminal RST1, an initial voltage signal terminal Vint, and the driving sub-circuit 11.

The first reset signal terminal RST1 is configured to receive a first reset signal and output the first reset signal to the reset sub-circuit 13. The initial voltage signal terminal Vint is configured to receive an initial voltage signal and output the initial voltage signal to the reset sub-circuit 13.

The reset sub-circuit 13 is configured to, in response to the first reset signal received from the first reset signal terminal RST1, transmit the initial voltage signal provided from the initial voltage signal terminal Vint to the driving sub-circuit 11.

In some examples, as shown in FIG. 8, the reset sub-circuit 13 includes a seventh transistor T7. A gate of the seventh transistor T7 is connected to the first reset signal terminal RST1, a first electrode of the seventh transistor T7 is connected to the initial voltage signal terminal Vint, and a second electrode of the seventh transistor T7 is connected to the driving sub-circuit 11. Here, the second electrode of the seventh transistor T7 is connected to the node N1, i.e., is connected to the gate of the driving transistor T1.

The seventh transistor T7 is configured to, in response to the first reset signal received from the first reset signal terminal RST1, transmit the initial voltage signal provided from the initial voltage signal terminal Vint to the node N1, so that the gate voltage of the driving transistor T1 is reset to a voltage of the initial voltage signal.

In some other embodiments, as shown in FIG. 6, the reset sub-circuit 13 is to connected to the first reset signal terminal RST1, a second reset signal terminal RST2, the initial voltage signal terminal Vint, the driving sub-circuit 11, and the element to be driven D.

The reset sub-circuit 13 is configured to: in response to the first reset signal received from the first reset signal terminal RST1, transmit the initial voltage signal provided from the initial voltage signal terminal Vint to the driving sub-circuit 11; and in response to a second reset signal received from the second reset signal terminal RST2, transmit the initial voltage signal provided from the initial voltage signal terminal Vint to the element to be driven D.

In some examples, as shown in FIG. 9, the reset sub-circuit 13 includes the seventh transistor T7 and an eighth transistor T8.

The gate of the seventh transistor T7 is connected to the first reset signal terminal RST1, the first electrode of the seventh transistor T7 is connected to the initial voltage signal terminal Vint, and the second electrode of the seventh transistor T7 is connected to the driving sub-circuit 11. Here, the second electrode of the seventh transistor T7 is connected to the node N1, i.e., is connected to the gate of the driving transistor T1.

A gate of the eighth transistor T8 is connected to the second reset signal terminal RST2, a first electrode of the eighth transistor T8 is connected to the initial voltage signal terminal Vint, and a second electrode of the eighth transistor T8 is connected to the element to be driven D. Here, the second electrode of the eighth transistor T8 is connected to the first electrode of the element to be driven D.

The seventh transistor T7 is configured to, in response to the first reset signal received from the first reset signal terminal RST1, transmit the initial voltage signal provided from the initial voltage signal terminal Vint to the node N1, so that the gate voltage of the driving transistor T1 is reset to the voltage of the initial voltage signal.

The eighth transistor T8 is configured to, in response to the second reset signal received from the second reset signal terminal RST2, transmit the initial voltage signal provided from the initial voltage signal terminal Vint to the first electrode of the element to be driven D, so that a voltage of the first electrode of the element to be driven D is reset to the voltage of the initial voltage signal.

In the pixel driving circuit in some embodiments of the present disclosure, the driving sub-circuit 11 and the element to be driven D are reset by the reset sub-circuit 13, which may eliminate residual signals in the driving sub-circuit 11 and the element to be driven D in an image display of a previous frame, and avoids an influence of the residual signals on a driving current in an image display of a current frame, thereby helping to improve an image display effect.

The embodiments of the present disclosure do not limit the magnitude of the voltage of the initial voltage signal, as long as the voltage of the initial voltage signal is able to ensure that the driving transistor T1 is in an off state when the reset sub-circuit 13 operates. For example, the initial voltage signal is a low-level signal or a high-level signal.

The embodiments of the present disclosure do not limit the types of the driving transistor T1, the second transistor T2, the third transistor T3, the fourth transistor T4, the fifth transistor T5, the sixth transistor T6, the seventh transistor T7, and the eighth transistor T8. For example, as shown in FIGS. 7 to 9, the driving transistor T1, the second transistor T2, the third transistor T3, the fourth transistor T4, the fifth transistor T5, the sixth transistor T6, the seventh transistor T7, and the eighth transistor T8 are all P-type transistors. For another example, the driving transistor T1, the second transistor T2, the third transistor T3, the fourth transistor T4, the fifth transistor T5, the sixth transistor T6, the seventh transistor T7, and the eighth transistor T8 are all N-type transistors.

For example, as shown in FIG. 9, the pixel driving circuit 1 includes the driving transistor T1, the second transistor T2, the third transistor T3, the fourth transistor T4, the fifth transistor T5, the sixth transistor T6, the seventh transistor T7, the eighth transistor T8, and the capacitor C1.

The gate of the driving transistor T1 is connected to the node N1, the first electrode of the driving transistor T1 is connected to the second electrode of the second transistor T2, the second electrode of the fourth transistor T4, and the second electrode of the fifth transistor T5. The second electrode of the driving transistor T1 is connected to the first electrode of the third transistor T3, and the first electrode of the sixth transistor T6.

The end of the capacitor C1 is connected to the node N1, and the another end of the capacitor C1 is connected to the first power supply voltage signal terminal VDD.

The gate of the second transistor T2 is connected to the first scanning signal terminal G1, and the first electrode of the second transistor T2 is connected to the first data signal terminal Data1.

The gate of the third transistor T3 is connected to the third scanning signal terminal G3, and the second electrode of the third transistor T3 is connected to the node N1.

The gate of the fourth transistor T4 is connected to the second scanning signal terminal G2, and the first electrode of the fourth transistor T4 is connected to the second data signal terminal Data2.

The gate of the fifth transistor T5 is connected to the enable signal terminal EM, and the first electrode of the fifth transistor T5 is connected to the first power supply voltage signal terminal VDD.

The gate of the sixth transistor T6 is connected to the enable signal terminal EM, and the second electrode of the sixth transistor T6 is connected to the first electrode of the element to be driven D.

The gate of the seventh transistor T7 is connected to the first reset signal terminal RST1, the first electrode of the seventh transistor T7 is connected to the initial voltage signal terminal Vint, and the second electrode of the seventh transistor T7 is connected to the node N1.

The gate of the eighth transistor T8 is connected to the second reset signal terminal RST2, the first electrode of the eighth transistor T8 is connected to the initial voltage signal terminal Vint, and the second electrode of the eighth transistor T8 is connected to the first electrode of the element to be driven D.

Figure 10:
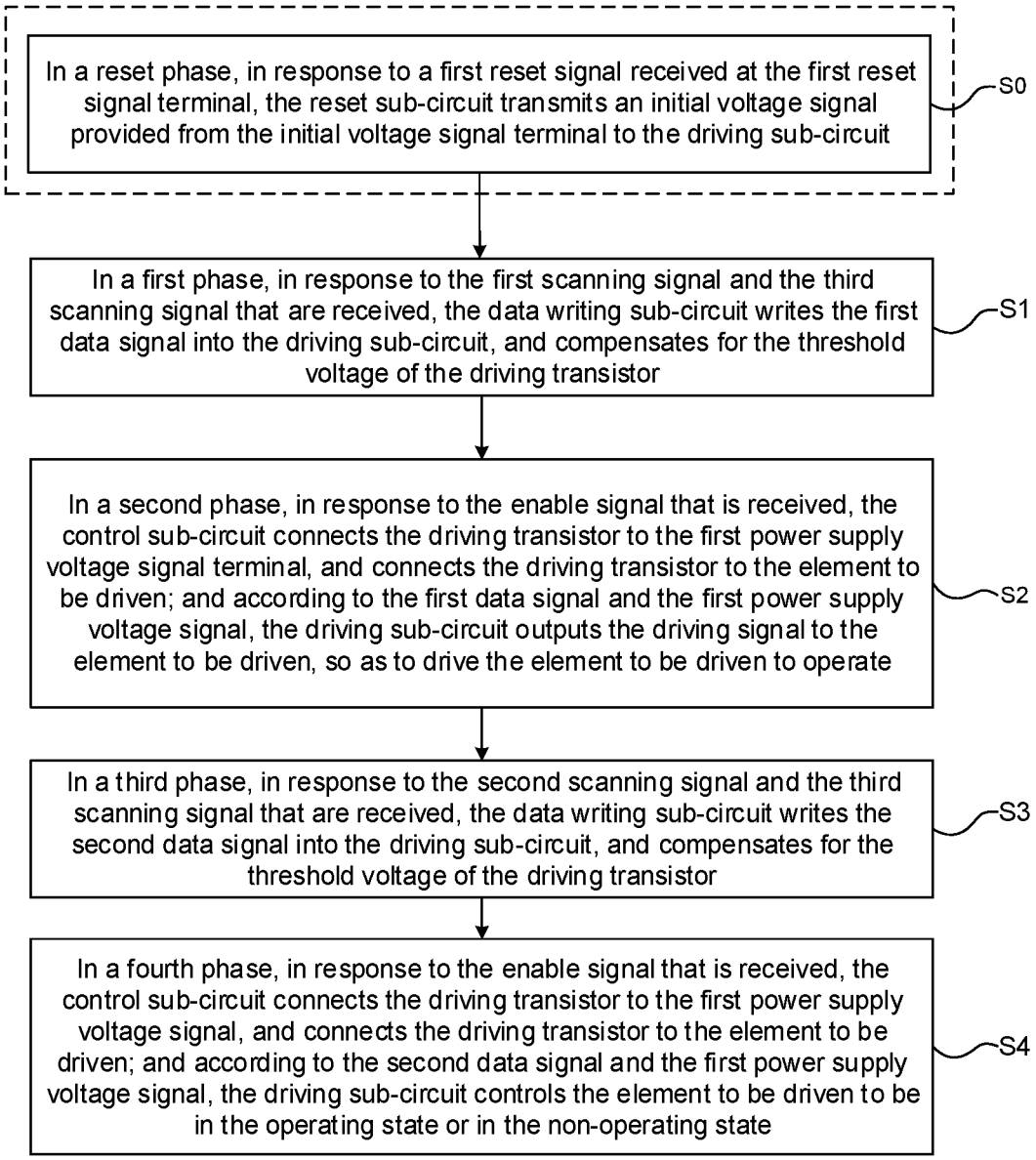
FIG. 10 is a flow diagram of a driving method for a pixel driving circuit, in accordance with some embodiments of the present disclosure.
Figure 11A:
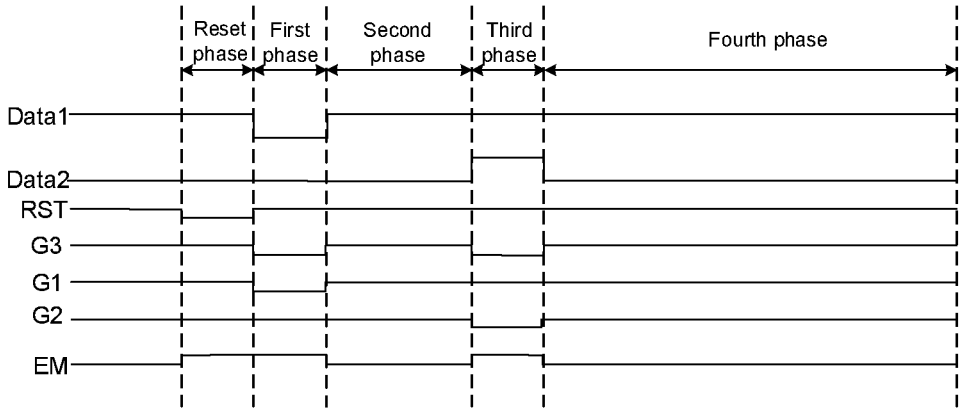
FIG. 11A is a timing diagram of a pixel driving circuit, in accordance with some embodiments of the present disclosure.
Figure 11B:
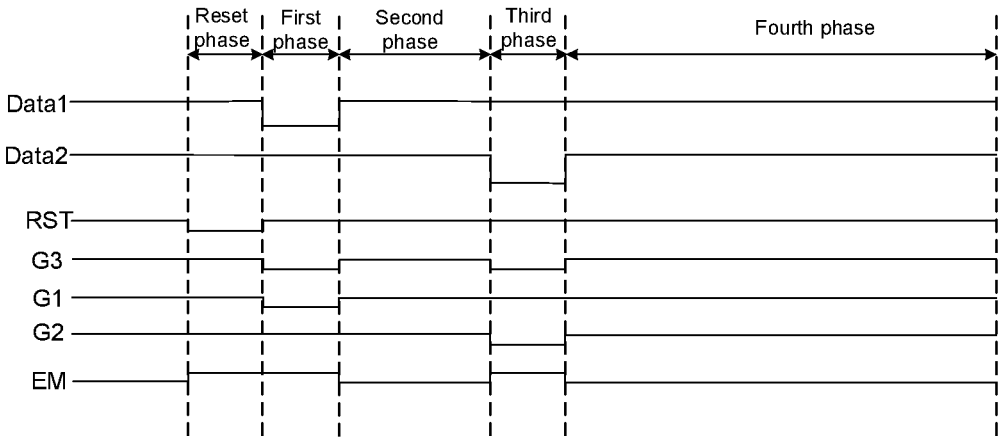
FIG. 11B is a timing diagram of another pixel driving circuit, in accordance with some embodiments of the present disclosure.

Some embodiments of the present disclosure further provide a driving method for the pixel driving circuit. As shown in FIGS. 11A and 11B, an image frame includes a first phase to a fourth phase. In some embodiments, as shown in FIG. 10, the driving method includes S1 to S4.

In S1, in the first phase of the image frame, in response to the first scanning signal received from the first scanning signal terminal G1 and the third scanning signal received from the third scanning signal terminal G3, the data writing sub-circuit 10 writes the first data signal provided from the first data signal terminal Data1 into the driving sub-circuit 11, and compensates for the threshold voltage of the driving transistor T1.

In some examples, as shown in FIG. 4, the pixel driving circuit 1 includes the driving sub-circuit 11, the control sub-circuit 12, and the data writing sub-circuit 10. The driving sub-circuit 11 includes the driving transistor T1. The data writing sub-circuit 10 includes the first data writing sub-circuit 100 and the second data writing sub-circuit 101. The control sub-circuit 12 is connected to the enable signal terminal EM, the first power supply voltage signal terminal VDD, the driving sub-circuit 11, and the element to be driven D. The first data writing sub-circuit 100 is connected to the first scanning signal terminal G1, the third scanning signal terminal G3, the first data signal terminal Data1, and the driving sub-circuit 11. The second data writing sub-circuit 101 is connected to the second scanning signal terminal G2, the third scanning signal terminal G3, the second data signal terminal Data2, and the driving sub-circuit 11. The driving sub-circuit 11 is further connected to the first power supply voltage signal terminal VDD.

Referring to FIGS. 4, 11A and 11B, S1 includes S11.

In S11, in the first phase, in response to the first scanning signal received from the first scanning signal terminal G1 and the third scanning signal received from the third scanning signal terminal G3, the first data writing sub-circuit 100 writes the first data signal provided from the first data signal terminal Data1 into the driving sub-circuit 11, and compensates for the threshold voltage of the driving transistor T1.

In the first phase, the first power supply voltage signal terminal VDD and the driving transistor T1 are disconnected, and the driving transistor T1 and the element to be driven D are disconnected.

For example, as shown in FIG. 7, the driving sub-circuit 11 includes the driving transistor T1 and the capacitor C1. The first data writing sub-circuit 100 includes the second transistor T2 and the third transistor T3. The second data writing sub-circuit 101 includes the third transistor T3 and the fourth transistor T4. The control sub-circuit 12 includes the fifth transistor T5 and the sixth transistor T6. The driving transistor T1, the second transistor T2, the third transistor T3, the fourth transistor T4, the fifth transistor T5, and the sixth transistor T6 are all P-type transistors. Connection methods of the driving transistor T1, the capacitor C1, the second transistor T2, the third transistor T3, the fourth transistor T4, the fifth transistor T5, and the sixth transistor T6 refer to the above descriptions, which will not be repeated here.

For the short-scan operating mode, referring to FIGS. 7 and 11A, S11 includes S111.

In S111, in the first phase, in response to the first scanning signal received from the first scanning signal terminal G1, the second transistor T2 is turned on to transmit the first data signal provided from the first data signal terminal Data1 to the first electrode of the driving transistor T1. In response to the third scanning signal received from the third scanning signal terminal G3, the third transistor T3 is turned on, so that the second electrode of the driving transistor T1 and the gate of the driving transistor T1 are short-circuited, and the first data signal (the voltage thereof is denoted as $V_{Data1}$) and the threshold voltage of the driving transistor T1 are written into the gate of the driving transistor T1, which compensates for the threshold voltage of the driving transistor T1.

In this way, the gate voltage of the driving transistor T1 is equal to $(V_{Data1}+V_{th})$.

In the first phase, the fifth transistor T5 and the sixth transistor T6 are in the off state. The fifth transistor T5 is in the off state, so that the first power supply voltage signal terminal VDD and the first electrode of the driving transistor T1 are disconnected. In this way, the first power supply voltage signal provided from the first power supply voltage signal terminal VDD cannot be transmitted to the first electrode of the driving transistor T1. The sixth transistor T6 is in the off state, so that the second electrode of the driving transistor T1 and the first electrode of the element to be driven D are disconnected.

Referring to FIGS. 7 and 11B, the first phase of the long-scan operating mode is exactly the same as the first phase of the short-scan operating mode, and thus will not be repeated here.

In S2, in the second phase of the image frame, in response to the enable signal received from the enable signal terminal EM, the control sub-circuit 12 connects the driving transistor T1 to the first power supply voltage signal terminal VDD, and connects the driving transistor T1 to the element to be driven D. According to the first data signal provided from the first data signal terminal Data1 and the first power supply voltage signal provided from the first power supply voltage signal terminal VDD, the driving sub-circuit 11 outputs the driving signal to the element to be driven D, so as to drive the element to be driven D to operate.

In some examples, referring to FIGS. 4, 11A and 11B, S2 includes S21.

In S21, in the second phase, in response to the enable signal received from the enable signal terminal EM, the control sub-circuit 12 connects the driving transistor T1 to the first power supply voltage signal terminal VDD, and connects the driving transistor T1 to the element to be driven D. According to the first data signal provided from the first data signal terminal Data1 and the first power supply voltage signal provided from the first power supply voltage signal terminal VDD, the driving transistor T1 outputs the driving signal to the element to be driven D, so as to drive the element to be driven D to operate.

For the short-scan operating mode, referring to FIGS. 7 and 11A, S21 includes S211.

In S211, in the second phase, in response to the enable signal received from the enable signal terminal EM, the fifth transistor T5 is turned on to connect the first power supply voltage signal terminal VDD to the first electrode of the driving transistor T1, so as to transmit the first power supply voltage signal provided from the first power supply voltage signal terminal VDD to the first electrode of the driving transistor T1. In response to the enable signal received from the enable signal terminal EM, the sixth transistor T6 is turned on to connect the second electrode of the driving transistor T1 to the first electrode of the element to be driven D.

In this way, the voltage of the first electrode of the driving transistor T1 is the voltage $V_{dd}$ of the first power supply voltage signal. In a case where the gate voltage $(V_{Data1}+V_{th})$ of the driving transistor T1 and the voltage $V_{dd}$ of the first electrode of the driving transistor T1 satisfy a condition that $V_{Data1}+V_{th}-V_{dd}<V_{th}$, i.e., $V_{Data1}-V_{dd}<0$, the driving transistor T1 is turned on and outputs the driving signal.

Referring to FIGS. 7 and 11B, the second phase of the long-scan operating mode is exactly the same as the second phase of the short-scan operating mode, and thus will not be repeated here.

In S3, in the third phase of the image frame, in response to the second scanning signal received from the second scanning signal terminal G2 and the third scanning signal received from the third scanning signal terminal G3, the data writing sub-circuit 10 writes the second data signal provided from the second data signal terminal Data2 into the driving sub-circuit 11, and compensates for the threshold voltage of the driving transistor T1.

In the third phase, after the second data signal provided from the second data signal terminal Data2 is written into the driving sub-circuit 11, and the threshold voltage of the driving transistor T1 is compensated, the driving transistor T1 is turned off. A voltage of the enable signal is controlled synchronously, so that the first power supply voltage signal terminal VDD and the driving transistor T1 are disconnected, and the driving transistor T1 and the element to be driven D are disconnected.

In some examples, referring to FIGS. 4, 11A and 11B, S3 includes S31.

In S31, in the third phase, in response to the second scanning signal received from the second scanning signal terminal G2 and the third scanning signal received from the third scanning signal terminal G3, the second data writing sub-circuit 101 writes the second data signal provided from the second data signal terminal Data2 into the driving sub-circuit 11, and compensates for the threshold voltage of the driving transistor T1.

For the short-scan operating mode, for example, referring to FIGS. 7 and 11A, S31 includes S311.

In S311, in the third phase, in response to the second scanning signal received from the second scanning signal terminal G2, the fourth transistor T4 is turned on to transmit the second data signal provided from the second data signal terminal Data2 to the first electrode of the driving transistor T1; and in response to the third scanning signal received from the third scanning signal terminal G3, the third transistor T3 is turned on, so that the second electrode of the driving transistor T1 and the gate of the driving transistor T1 are short-circuited, and the second data signal (the voltage thereof is denoted as $V_{Data2}$) and the threshold voltage of the driving transistor T1 are written into the gate of the driving transistor T1, which compensations for the threshold voltage of the driving transistor T1.

In this way, a gate voltage of the driving transistor T1 is equal to ($V_{Data2}+V_{th}$).

In the third phase, the fifth transistor T5, and the sixth transistor T6 are in the off state. The fifth transistor T5 is in the off state, so that the first power supply voltage signal terminal VDD and the first electrode of the driving transistor T1 are disconnected. As a result, the first power supply voltage signal provided from the first power supply voltage signal terminal VDD cannot be transmitted to the first electrode of the driving transistor T1. The sixth transistor T6 is in the off state, so that the second electrode of the driving transistor T1 and the first electrode of the element to be driven D are disconnected.

In the short-scan operating mode, as shown in FIG. 11A, the voltage $V_{Data2}$ of the second data signal provided from the second data signal terminal Data2 is greater than or equal to the voltage $V_{dd}$ of the first power supply voltage signal, so that the driving transistor T1 is in the off state in the fourth phase.

Referring to FIGS. 7 and 11B, a process of the third phase of the long-scan operating mode is the same as the process of the third phase of the short-scan operating mode, and thus will not be repeated here. However, in the long-scan operating mode, as shown in FIG. 11B, the voltage $V_{Data2}$ of the second data signal provided from the second data signal terminal Data2 is less than the voltage $V_{dd}$ of the first power supply voltage signal, so that the driving transistor T1 is turned on.

In S4, in the fourth phase of the image frame, in response to the enable signal received from the enable signal terminal EM, the control sub-circuit 12 connects the driving transistor T1 to the first power supply voltage signal terminal VDD, and connects the driving transistor T1 to the element to be driven D, and according to the second data signal provided from the second data signal terminal Data2 and the first power supply voltage signal provided from the first power supply voltage signal terminal VDD, the driving sub-circuit 11 controls the element to be driven D to be in the operating state or in the non-operating state.

In some examples, referring to FIGS. 4, 11A and 11B, S4 includes S41.

In S41, in the fourth phase, in response to the enable signal received from the enable signal terminal EM, the control sub-circuit 12 connects the driving transistor T1 to the first power supply voltage signal terminal VDD, and connects the driving transistor T1 to the element to be driven D, and according to the second data signal provided from the second data signal terminal Data2 and the first power supply voltage signal provided from the first power supply voltage signal terminal VDD, the driving transistor T1 controls the element to be driven D to be in the operating state or in the non-operating state.

For the short-scan operating mode, for example, referring to FIGS. 7 and 11A, S41 includes S411.

In S411, in the fourth phase, in response to the enable signal received from the enable signal terminal EM, the fifth transistor T5 is turned on to connect the first power supply voltage signal terminal VDD to the first electrode of the driving transistor T1, so as to transmit the first power supply voltage signal provided from the first power supply voltage signal terminal VDD to the first electrode of the driving transistor T1; and in response to the enable signal received from the enable signal terminal EM, the sixth transistor T6 is turned on to connect the second electrode of the driving transistor T1 to the first electrode of the element to be driven D.

In this way, the voltage of the first electrode of the driving transistor T1 is the voltage $V_{dd}$ of the first power supply voltage signal. Since $V_{Data2}$ is greater than or equal to $V_{dd}$, and a voltage difference ($V_{Data2}+V_{th}-V_{dd}$) between the gate and the first electrode of the driving transistor T1 is greater than or equal to $V_{th}$ ($V_{Data2}+V_{th}-V_{dd}\geq V_{th}$, i.e., $V_{Data2}-V_{dd}\geq 0$), the driving transistor T1 is in the off state. Therefore, the driving transistor T1 cannot output the driving signal, and the element to be driven D is in the non-operating state. It can be seen that in the short-scan operating mode, the operating duration of the element to be driven D is equal to the duration of the second phase.

In the above process, the duration of the second phase is determined by a time point when the second data signal is written into the driving sub-circuit 11. That is, the later the second data signal is written into the driving sub-circuit 11, the longer the duration of the second phase is. The time point of writing the second data signal may be determined by an integrated circuit (IC). Therefore, the time point of writing the second data signal is controlled by changing an algorithm of the IC, thereby adjusting the operating duration of the element to be driven D in the short-scan operating mode.

For example, the operating duration in the short-scan operating mode is with a range of TN to T, where T is a duration of an image frame, and V is a vertical resolution of a display panel.

Referring to FIGS. 7 and 11B, in the long-scan operating mode, since $V_{Data2}$ is less than $V_{dd}$, and the voltage difference ($V_{Data2}+V_{th}-V_{dd}$) between the gate and the first electrode of the driving transistor T1 is less than $V_{th}$ ($V_{Data2}+V_{th}-V_{dd}<V_{th}$, i.e., $V_{Data2}-V_{dd}<0$), the driving transistor T1 is turned on and outputs the driving signal, and the element to be driven D is in the operating state. Therefore, in the long-scan operating mode, the operating duration of the element to be driven D is equal to the sum of the duration of the second phase and the duration of the fourth phase.

The operating duration of the element to be driven D in the long-scan operating mode may be adjusted by adjusting the duration of the second phase, and a method for adjusting the duration of the second phase may refer to the method for adjusting the duration of the second phase in the short-scan operating mode.

For example, the operating duration of the element to be driven D in the long-scan operating mode is approximate to 1 T.

It will be noted that since the duration of the first phase is equal to a duration of writing the first data signal into the pixel driving circuit, the duration of the third phase is equal to a duration of writing the second data signal into the pixel driving circuit, and the duration of writing the first data signal and the duration of writing the second data signal are both short, a proportion of the duration of the first phase and the duration of the third phase is small in an entire duration 1 T of the image frame.

In some other embodiments, as shown in FIGS. 5 and 6, the pixel driving circuit 1 further includes the reset sub-circuit 13. The reset sub-circuit 13 is connected to the first reset signal terminal RST1, the initial voltage signal terminal Vint, and the driving sub-circuit 11.

Before the first phase of the image frame, the driving method for the pixel driving circuit further includes S0.

In S0, in the reset phase of the image frame, in response to the first reset signal received from the first reset signal terminal RST1, the reset sub-circuit 13 transmits the initial voltage signal provided from the initial voltage signal terminal Vint to the driving sub-circuit 11.

For example, as shown in FIG. 8, the reset sub-circuit 13 includes the seventh transistor T7, and a connection mode of the seventh transistor T7 refers to the above descriptions, which will not be repeated here.

Referring to FIGS. 8 and 11A, or FIGS. 8 and 11B, S0 includes S011.

In S011, in the reset phase, in response to the first reset signal received from the first reset signal terminal RST1, the seventh transistor T7 is turned on to transmit the initial voltage signal provided from the initial voltage signal terminal Vint to the node N1, so that the gate voltage of the driving transistor T1 is reset to the voltage of the initial voltage signal.

In some other examples, as shown in FIG. 6, the reset sub-circuit 13 is connected to the first reset signal terminal RST1, the second reset signal terminal RST2, the initial voltage signal terminal Vint, the driving sub-circuit 11, and the element to be driven D.

In S0, in response to the second reset signal received from the second reset signal terminal RST2, the reset sub-circuit 13 further transmits the initial voltage signal provided from the initial voltage signal terminal Vint to the element to be driven D.

For example, as shown in FIG. 9, the reset sub-circuit 13 includes the seventh to transistor T7 and the eighth transistor T8, and connection modes of the seventh transistor T7 and the eighth transistor T8 refer to the above descriptions, which will not be repeated here.

Referring to FIGS. 9 and 11A, or FIGS. 9 and 11B, S0 includes S011'.

In S011', in response to the first reset signal received from the first reset signal terminal RST1, the seventh transistor T7 is turned on to transmit the initial voltage signal provided from the initial voltage signal terminal Vint to the node N1, so that the gate voltage of the driving transistor T1 is reset to the voltage of the initial voltage signal; and in response to the second reset signal received from the second reset signal terminal RST2, the eighth transistor T8 is turned on to transmit the initial voltage signal provided from the initial voltage signal terminal Vint to the first electrode of the element to be driven D, so that the voltage of the first electrode of the element to be driven D is reset to the voltage of the initial voltage signal.

The driving method for the pixel driving circuit in some embodiments of the present disclosure has same beneficial effects as the pixel driving circuit 1 described above, which will not be repeated here.

It will be noted that the above description of the pixel driving circuit 1 and the description of the driving method for the pixel driving circuit are both based on a fact that the first data signal terminal Data1 and the second data signal terminal Data2 are connected to different data lines. Of course, the first data signal terminal Data1 and the second data signal terminal Data2 may also be connected to a same data line.

In some embodiments, referring to FIGS. 7 to 9, the first data signal terminal Data1 is connected to a first data line, and the second data signal terminal Data2 is connected to a second data line. That is, the first data signal is transmitted through the first data line, and the second data signal is transmitted through the second data line.

In some examples, after the first data signals are input to the pixel driving circuits 1 in any row of sub-pixel regions of the display panel through a plurality of first data lines, and the elements to be driven D in the row of sub-pixel regions emit light, the second data signals may be input to the pixel driving circuits 1 in the row of sub-pixel regions through a plurality of second data lines. Therefore, the pixel driving circuits 1 in each row of sub-pixel regions in the display panel may independently and continuously perform the first phase to the fourth phase. That is, for the pixel driving circuits 1 in the row of sub-pixel regions, after the first phase is completed, the second phase, the third phase, and the fourth phase are carried out in sequence.

In summary, the first data signal and the second data signal are transmitted without interfering with each other, and each has a high transmission efficiency.

Figure 12:
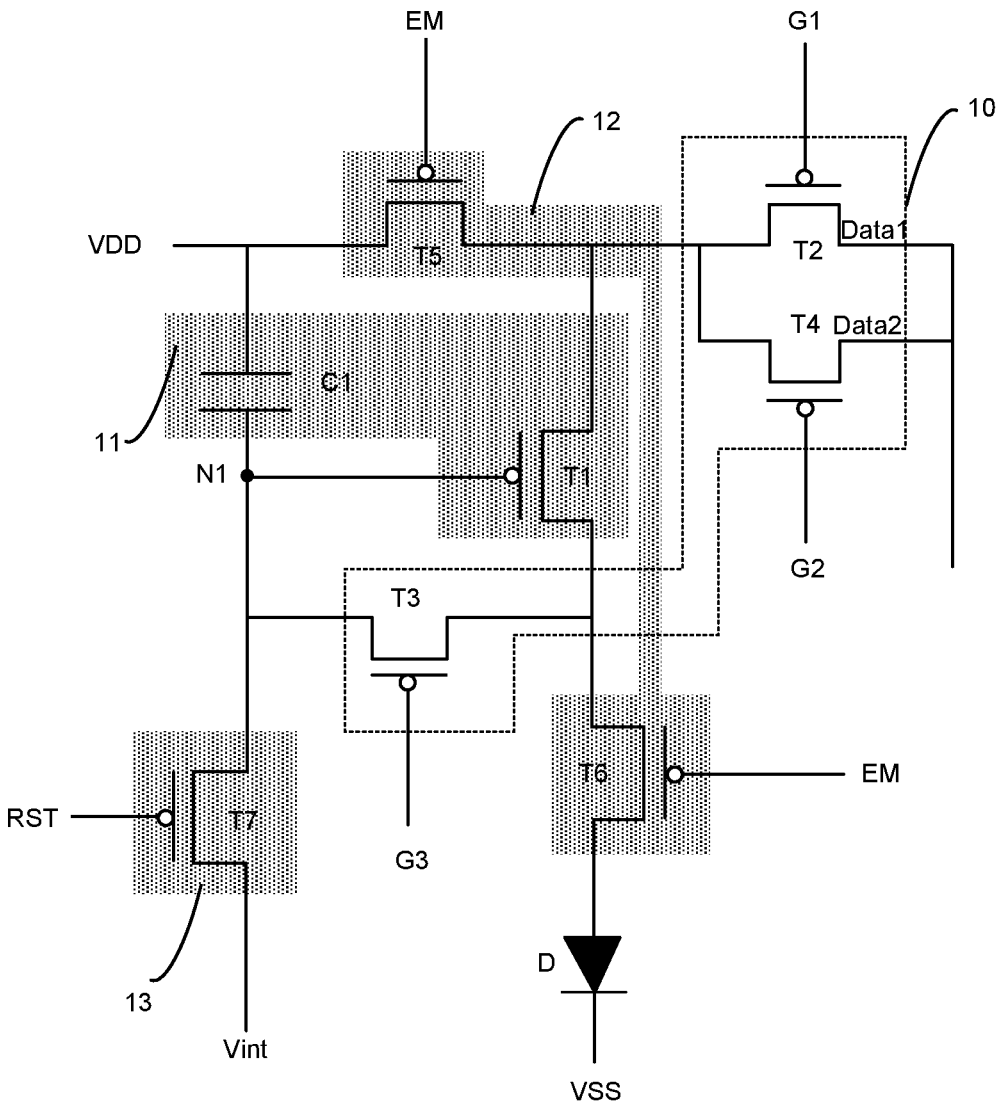
FIG. 12 is a circuit configuration diagram of yet another pixel driving circuit, in accordance with some embodiments of the present disclosure.

In some other embodiments, referring to FIG. 12, the first data signal terminal Data1 and the second data signal terminal Data2 are connected to a same data line. That is, the first data signal and the second data signal are transmitted through the same data line.

Since the first data signal and the second data signal are transmitted through the same data line, when the display panel operates, it is required to first input the first data signals to the pixel driving circuits 1 in the sub-pixel regions through a plurality of data lines, and then input the second data signals to the pixel driving circuits 1 in the sub-pixel regions through the plurality of data lines.

In some examples, when the display panel operates, the first data signals are input to the pixel driving circuits 1 in a first row of sub-pixel regions through the plurality of data lines, until the first data signals are input to the pixel driving circuits 1 in a last row of sub-pixel regions. When the first data signals are input to the pixel driving circuits 1 in a row of sub-pixel regions, the elements to be driven D in the row of sub-pixel regions start to emit light. Then, the second data signals are input to the pixel driving circuits 1 in the first row of sub-pixel regions through the plurality of data lines, until the second data signals are input to the pixel driving circuits 1 in the last row of sub-pixel regions.

In summary, the first data signal and the second data signal are transmitted through the same data line, which may reduce a number of data lines, simplify a circuit configuration of the pixel driving circuit 1, and reduce the manufacturing costs.

For example, as shown in FIG. 12, the data writing sub-circuit 10 includes the second transistor T2, the third transistor T3, and the fourth transistor T4. The driving sub-circuit 11 includes the driving transistor T1 and the capacitor C1. The control sub-circuit 12 includes the fifth transistor T5 and the sixth transistor T6. The reset sub-circuit 13 includes the seventh transistor T7. The connection modes of the driving transistor T1, the capacitor C1, the second transistor T2, the third transistor T3, the fourth transistor T4, the fifth transistor T5, the sixth transistor T6, and the seventh transistor T7 refer to the above descriptions, which will not be repeated here. Hereinafter, a driving process of the pixel driving circuit 1 is described in a case where the first data signal terminal Data1 and the second data signal terminal Data2 are connected to the same data line.

For the pixel driving circuit in FIG. 12, in combination with FIG. 11A, in the short-scan operating mode, in the first phase, starting from the pixel driving circuits 1 in the first row of sub-pixel regions, the first data signals (the voltage thereof is denoted as $V_{Data1}$) are input to the nodes N1 of the pixel driving circuits 1 in the row of sub-pixel regions, the threshold voltages of the driving transistors T1 of the pixel driving circuits 1 in the row of sub-pixel regions are written into the nodes N1 of corresponding pixel driving circuits 1, until the first data signals are input to the nodes N1 of the pixel driving circuits 1 in the last row of sub-pixel regions, and the threshold voltages of the driving transistors T1 of the pixel driving circuits 1 in this row of sub-pixel regions are written into the nodes N1 of corresponding pixel driving circuits 1. In this case, the gate voltage of the driving transistor T1 of each pixel driving circuit 1 is equal to $(V_{Data1}+V_{th})$.

It will be noted that the voltages $V_{Data1}$ of the first data signals input to the pixel driving circuits 1 in the rows of sub-pixel regions may be the same or different.

In the first phase, the duration of the first phase is equal to a sum of durations required for inputting the first data signals to the pixel driving circuits 1 in the first row of sub-pixel regions until inputting the first data signals to the pixel driving circuits 1 in the last row of sub-pixel regions. Therefore, the IC may be used to reduce the time for the first data signals to be input to the pixel driving circuits 1 in each row of sub-pixel regions, so as to shorten the duration of the first phase. In a case where the duration of the image frame is a constant value, shortening the duration of the first phase helps to reserve more time for subsequent phases. For example, the duration of the second phase may be increased.

For the pixel driving circuit in FIG. 12, in combination with FIG. 11B, the first phase of the long-scan operating mode is exactly the same as the first phase of the short-scan operating mode, which will not be repeated here.

In the second phase, for the short-scan operating mode, the gate voltage of the driving transistor T1 of each pixel driving circuit 1 is equal to $(V_{Data1}+V_{th})$. When $V_{Data1}+V_{th}-V_{dd}<V_{th}$, the driving transistor T1 is turned on and outputs the driving signal to the element to be driven D, thereby driving the element to be driven D to emit light until the end of the second phase. That is, in the second phase, elements to be driven D start to emit light simultaneously.

For the pixel driving circuit in FIG. 12, in combination with FIG. 11B, the second phase of the long-scan operating mode is exactly the same as the second phase of the short-scan operating mode, and thus will not be repeated here.

In the third phase, in combination with FIG. 12 and FIG. 11A, in the short-scan operating mode, starting from the pixel driving circuits 1 in the first row of sub-pixel regions, the second data signals (the voltage thereof is denoted as $V_{Data2}$) are input to the nodes N1 of the pixel driving circuits 1 in this row of sub-pixel regions, the threshold voltages of the driving transistors T1 of the pixel driving circuits 1 in this row of sub-pixel regions are written into the nodes N1 of corresponding pixel driving circuits 1, until the second data signals are input to the nodes N1 of the pixel driving circuits 1 in the last row of sub-pixel regions, and the threshold voltages of the driving transistors T1 of the pixel driving circuits 1 in this row of sub-pixel regions are written into the nodes N1 of the corresponding pixel driving circuits 1. In this case, the gate voltage of each driving transistor T1 is equal to $(V_{Data2}\ V_{th})$.

In the short-scan operating mode, the voltage $V_{Data2}$ of the second data signal input to the pixel driving circuit 1 is greater than or equal to the voltage $V_{dd}$ of the first power supply voltage signal.

In combination with FIG. 12 and FIG. 11B, the third phase of the long-scan operating mode is exactly the same as the third phase of the short-scan operating mode, and thus will not be repeated here. However, in the long-scan operating mode, the voltage $V_{Data2}$ of the second data signal input to the pixel driving circuit is less than the Voltage $V_{dd}$ of the first power supply voltage signal.

In the fourth phase, in combination with FIG. 12 and FIG. 11A, in the short-scan operating mode, the gate voltage of the driving transistor T1 of each pixel driving circuit 1 is equal to $(V_{Data2}+V_{th})$. When $V_{Data2}+V_{th}-V_{dd}\geq V_{th}$, the driving transistor T1 cannot be turned on, so that the corresponding element to be driven D continues to be in the non-light-emitting state.

It can be seen that in the short-scan operating mode, the operating duration of the element to be driven D is equal to the duration of the second phase. The method for adjusting the duration of the second phase may refer to the above description.

In combination with FIG. 12 and FIG. 11B, in the long-scan operating mode, the voltage $V_{Data2}$ of the second data signal is less than the voltage $V_{dd}$ of the first power supply voltage signal, i.e., $V_{Data2}+V_{th}-V_{dd}<V_{th}$. Therefore, the driving transistor T1 is turned on, so that the corresponding element to be driven D emits light again.

It will be noted that in the long-scan operating mode, in the fourth phase, since the second data signals input to all of the pixel driving circuits 1 may be different, $V_{Data2}$ input to part of the pixel driving circuits 1 may be greater than or equal to $V_{dd}$. In this way, part of the elements to be driven D emit light, and part of the elements to be driven D do not emit light. The elements to be driven D that emit light and the elements to be driven D that do not emit light may be determined according to gray scales of a displayed image.

The operating duration of the element to be driven D in the long-scan operating mode may be adjusted by adjusting the duration of the fourth phase, and the duration of the fourth phase may be set according to actual situations.

Some embodiments of the present disclosure further provide a display panel. The display panel includes a plurality of pixel driving circuits 1 as described above and a plurality of elements to be driven D. Each element to be driven D is connected to a corresponding pixel driving circuit 1.

In some embodiments, the display panel has a plurality of sub-pixel regions, and each pixel driving circuit 1 is disposed in a sub-pixel region.

The display panel further includes a plurality of first scanning signal lines, a plurality of second scanning signal lines, a plurality of third scanning signal lines, a plurality of first data lines, and a plurality of second data lines. In some examples, the first scanning signal terminals G1 connected to the pixel driving circuits 1 in a same row of sub-pixel regions are connected to a corresponding first scanning signal line. The second scanning signal terminals G2 connected to the pixel driving circuits 1 in a same row of sub-pixel regions are connected to a corresponding second scanning signal line. The third scanning signal terminals G3 connected to the pixel driving circuits 1 in a same row of sub-pixel regions are connected to a corresponding third scanning signal line. The first data signal terminals Data1 connected to the pixel driving circuits 1 in a same column of sub-pixel regions are connected to a corresponding first data line. The second data signal terminals Data2 connected to the pixel driving circuits 1 in a same column of sub-pixel regions are connected to a corresponding second data line.

Here, the first scanning signal terminals G1 connected to the pixel driving circuits 1 may be understood as equivalent connection points after the first scanning signal line is connected to the pixel driving circuits 1. The same principle applies to the second scanning signal terminals G2 and the third scanning signal terminals G3. Similarly, the first data signal terminals Data1 connected to the pixel driving circuits 1 may be understood as equivalent connection points after the first data line is connected to the pixel driving circuits 1. The same principle applies to the second data signal terminals Data2.

Figure 13A:
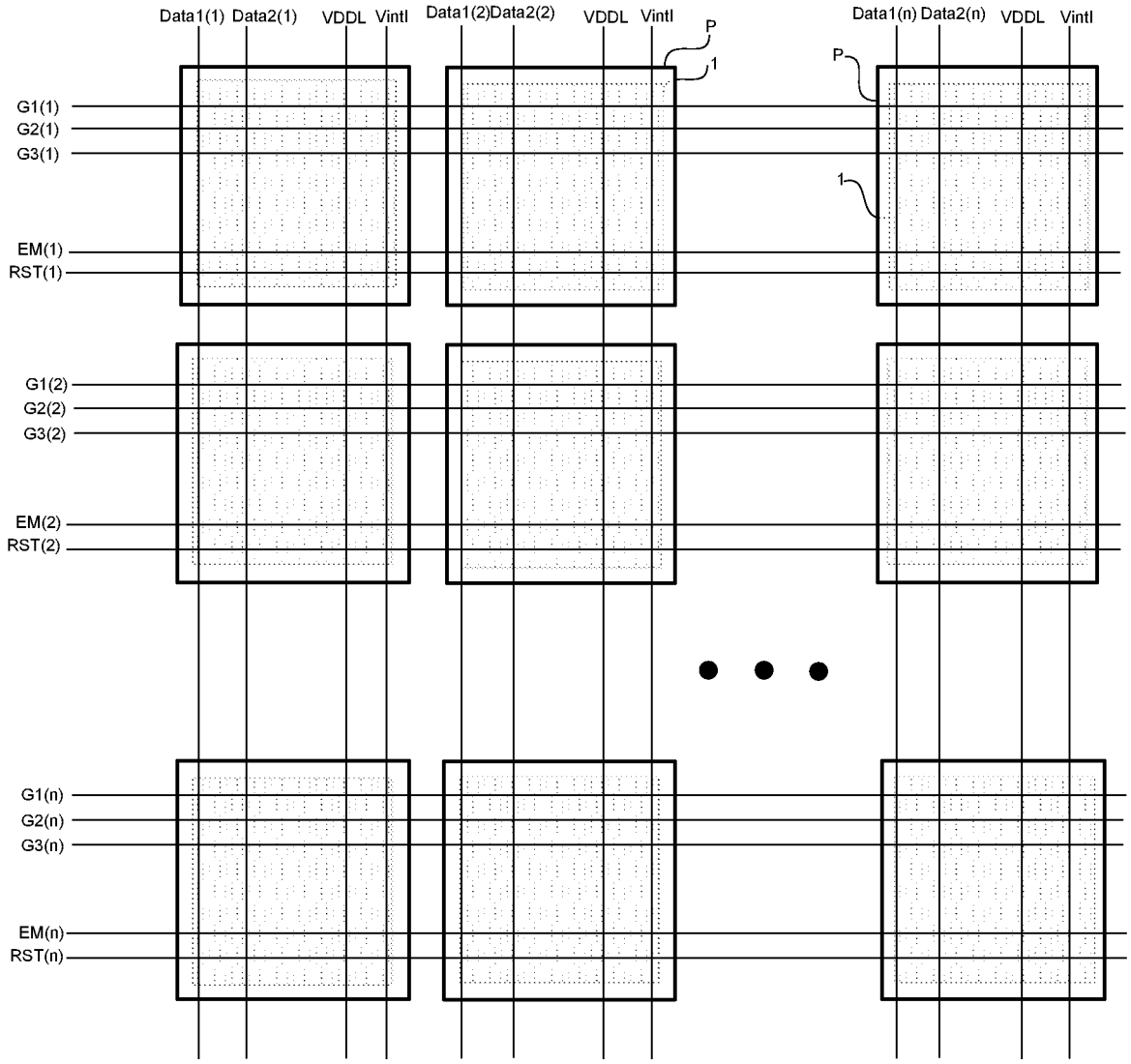
FIG. 13A is a structural diagram of a display panel, in accordance with some embodiments of the present disclosure.

For example, as shown in FIG. 13A, the display panel includes a plurality of first to scanning signal lines G1(1) to G1(*n*), a plurality of second scanning signal lines G2(1) to G2(*n*), a plurality of third scanning signal lines G3(1) to G3(*n*), a plurality of enable signal lines EM(1) to EM(n), and a plurality of reset signal lines RST(1) to RST(n). The first scanning signal lines are configured to provide first scanning signals to the pixel driving circuits 1. The second scanning signal lines are configured to provide second scanning signals to the pixel driving circuits 1. The third scanning signal lines are configured to provide third scanning signals to the pixel driving circuits 1. The enable signal lines EM(1) to EM(n) are configured to provide enable signals to the pixel driving circuits 1. The reset signal lines RST(1) to RST(n) are configured to provide reset signals to the pixel driving circuits 1.

Pixel driving circuits 1 in a same row of sub-pixel regions P are connected to a same one of the plurality of first scanning signal lines G1(1) to G1(*n*), a same one of the plurality of second scanning signal lines G2(1) to G2(*n*), a same one of the plurality of third scanning signal lines G3(1) to G3(*n*), a same one of the plurality of enable signal lines EM(1) to EM(n), and a same one of the plurality of reset signal lines RST(1) to RST(n).

The display panel further includes a plurality of first data lines Data1(1) to Data1(*n*), a plurality of second data lines Data2(1) to Data2(*n*), a plurality of first power supply voltage lines VDDL, and a plurality of initial voltage signal lines Vintl. The first data lines are configured to provide first data signals to the pixel driving circuits 1. The second data lines are configured to provide second data signals to the pixel driving circuits 1. The first power supply voltage lines VDDL are configured to provide first power supply voltage signals to the pixel driving circuits 1. The initial voltage signal lines Vintl are configured to provide initial voltage signals to the pixel driving circuits 1.

Pixel driving circuits 1 in a same column of sub-pixel regions P are connected to to a same one of the plurality of first data lines Data1(1) to Data1(*n*), a same one of the plurality of second data lines Data2(1) to Data2(*n*), a same one of the plurality of first power supply voltage lines VDDL, and a same one of the plurality of initial voltage signal lines Vintl.

For example, as shown in FIG. 13A, pixel driving circuits 1 in a same column of sub-pixel regions P are connected to both a first data line and a second data line.

When the display panel shown in FIG. 13A operates, after the first data signals are input to pixel driving circuits 1 in any row of sub-pixel regions in the display panel through the plurality of first data lines Data1(1) to Data1(*n*), and elements to be driven D in this row of sub-pixel regions emit light, the second data signals may be input to the pixel driving circuits 1 in this row of sub-pixel regions through the plurality of second data lines Data1(1) to Data1(*n*). Therefore, the elements to be driven D in all the sub-pixel regions P emit light row by row. Pixel driving circuits 1 in each row of sub-pixel regions P independently and continuously perform the first phase, the second phase, the third phase, and the fourth phase. In a case where an image frame includes the reset phase, the pixel driving circuits 1 in all the rows of sub-pixel regions P may perform the reset phase synchronously.

In some other embodiments, the display panel has a plurality of sub-pixel regions, and each pixel driving circuit 1 is disposed in a sub-pixel region.

The display panel further includes a plurality of first scanning signal lines, a plurality of second scanning signal lines, a plurality of third scanning signal lines, and a plurality of data lines. The first scanning signal terminals G1 connected to the pixel driving circuits 1 in a same row of sub-pixel regions are connected to a corresponding first scanning signal line. The second scanning signal terminals G2 connected to the pixel to driving circuits 1 in a same row of sub-pixel regions are connected a corresponding second scanning signal line. The third scanning signal terminals G3 connected to the pixel driving circuits 1 in a same row of sub-pixel regions are connected to a corresponding third scanning signal line. Both the first data signal terminals Data1 and the second data signal terminals Data2 connected to the pixel driving circuits 1 in a same column of sub-pixel regions are connected to a corresponding data line.

Here, the first scanning signal terminals G1 connected to the pixel driving circuits 1 may be understood as equivalent connection points after the first scanning signal line is connected to the pixel driving circuits 1. The same principle applies to the second scanning signal terminals G2 and the third scanning signal terminals G3. Similarly, the first data signal terminals Data1 connected to the pixel driving circuits 1 may be understood as equivalent connection points after the data line is connected to the pixel driving circuits 1. The same principle applies to the second data signal terminals Data2.

Figure 13B:
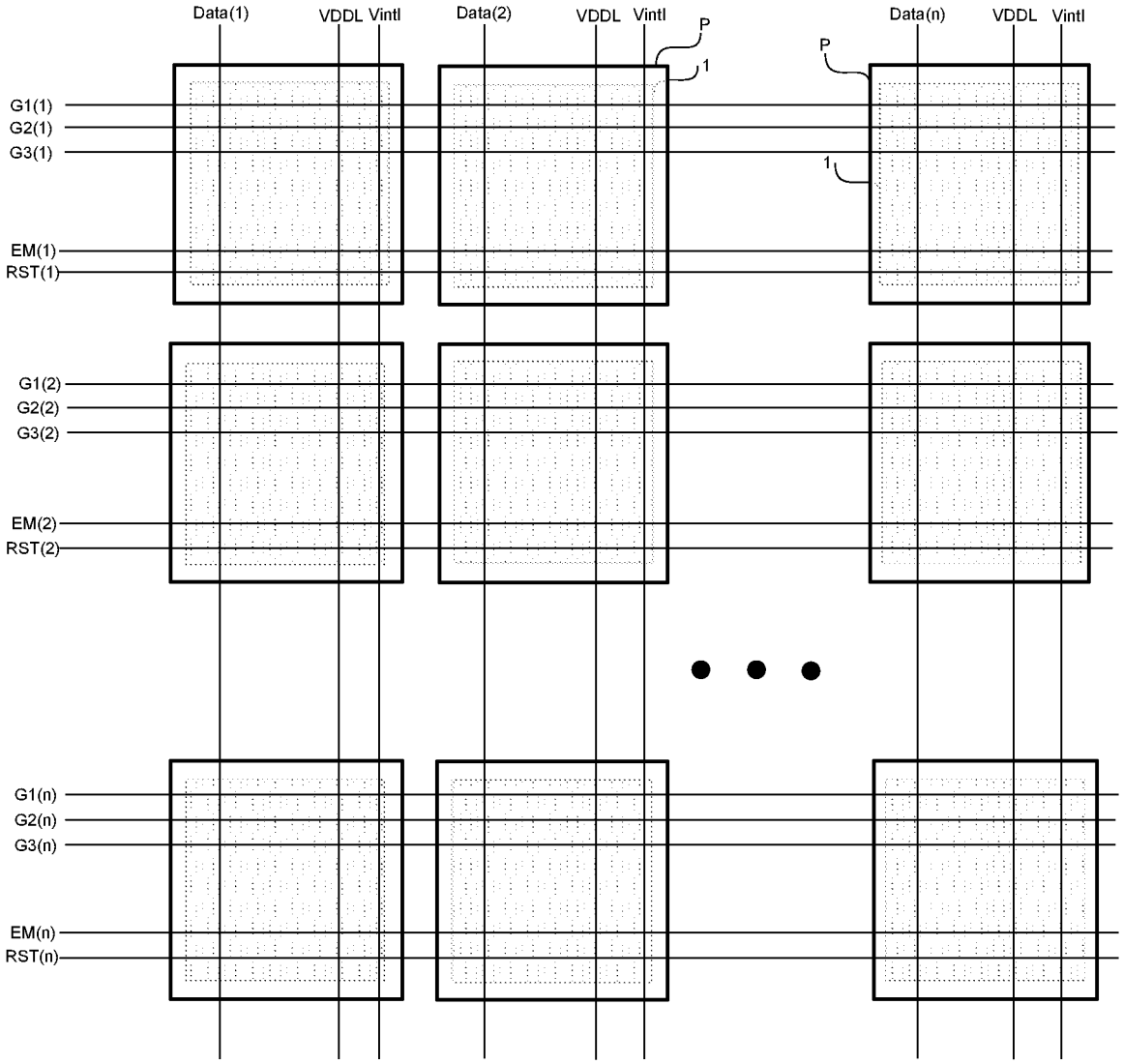
FIG. 13B is a structural diagram of another display panel, in accordance with some embodiments of the present disclosure.

For example, as shown in FIG. 13B, the difference from FIG. 13A is that the plurality of data lines Data(1) to Data(n)

replace the plurality of first data lines Data1(1) to Data1(*n*) and the plurality of second data lines Data2(1) to Data2(*n*). The pixel driving circuits 1 in each column of sub-pixel regions P are connected to only one of the plurality of data lines Data(1) to Data(n), and the data line is configured to provide first data signals and second data signals to the pixel driving circuits 1 in this column of sub-pixel regions P.

When the display panel shown in FIG. 13B operates, the first data signals are input to the pixel driving circuits 1 in a first row of sub-pixel regions through the plurality of data lines Data(1) to Data(n), until the first data signals are input to the pixel driving circuits 1 in a last row of sub-pixel regions. Therefore, the elements to be driven D in all the sub-pixel regions P emit light row by row. Then, the second data signals are input to to the pixel driving circuits 1 in the first row of sub-pixel regions through the plurality of data lines Data(1) to Data(n), until the second data signals are input to the pixel driving circuits 1 in the last row of sub-pixel regions. Here, the first data signals input to the pixel driving circuits 1 in all the rows of sub-pixel regions may be the same or different, and the second data signals input to the pixel driving circuits 1 in all the rows of sub-pixel regions may be the same or different. In a case where an image frame includes the reset phase, the pixel driving circuits 1 in all the rows of sub-pixel regions P may perform the reset phase synchronously.

The display panel in some embodiments of the present disclosure has same beneficial effects as the pixel driving circuit 1, which will not be repeated here.

It will be noted that arrangements of the plurality of signal lines included in the display panel and wiring diagrams of the display panel shown in FIGS. 13A and 13B are only some examples, which are not limited in the embodiments of the present disclosure.

Some embodiments of the present disclosure further provide a display device. The display device includes the display panel as described above.

Since the display device includes the display panel described above, the display device has characteristics of high luminous efficiency, small color coordinate offset, low energy consumption, and good display effect.

In some embodiments, the display device is a product with a display function, such as a television, a cellphone, a tablet computer, a notebook computer, a display, a digital photo frame or a navigator, which is not limited in the embodiments of the present disclosure.

The foregoing descriptions are merely specific implementation manners of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel driving circuit, comprising a data writing sub-circuit, a driving sub-circuit, and a control sub-circuit; the driving sub-circuit including a driving transistor, wherein the data writing sub-circuit is connected to a first scanning signal terminal, a second scanning signal terminal, a third scanning signal terminal, a first data signal terminal, a second data signal terminal, and the driving sub-circuit; and the data writing sub-circuit is configured to: in response to a first scanning signal received from the first scanning signal terminal and a third scanning signal received from the third scanning signal terminal, write a first data signal provided from the first data signal terminal into the driving sub-circuit, to and compensate for a threshold voltage of the driving transistor; and in response to a second scanning signal received from the second scanning signal terminal and the third scanning signal received from the third scanning signal terminal, write a second data signal provided from the second data signal terminal into the driving sub-circuit, and compensate for the threshold voltage of the driving transistor;

the control sub-circuit is connected to an enable signal terminal, a first power supply voltage signal terminal, the driving sub-circuit; the control sub-circuit is configured to be connected to an element to be driven; and the control sub-circuit is configured to, in response to an enable signal received from the enable signal terminal, connect the first power supply voltage signal terminal to the driving transistor, and connect the driving transistor to the element to be driven;

the driving sub-circuit is further connected to the first power supply voltage signal terminal; and the driving sub-circuit is configured to: according to the first data signal and a first power supply voltage signal provided from the first power supply voltage signal terminal, output a driving signal to the element to be driven, so as to drive the element to be driven to operate; and according to the second data signal and the first power supply voltage signal, control the element to be driven to be in an operating state or in a non-operating state;

the driving transistor is configured to be turned on and in a saturation state according to the second data signal, or be turned off according to the second data signal.

2. The pixel driving circuit according to claim 1, wherein in a case where the driving transistor is configured to be turned on and in the saturation state according to the second data signal, the driving sub-circuit is configured to according to the second data signal and the first power supply voltage signal, control the element to be driven to be in an operating state or in a non-operating state includes: the driving sub-circuit is configured to receive the second data signal, communicate with the first power supply voltage signal terminal and the element to be driven through the control sub-circuit, and according to the second data signal and the first power supply voltage signal, drive the element to be driven to operate.

3. The pixel driving circuit according to claim 1, wherein in a case where the driving transistor is configured to be turned on and in the saturation state according to the second data signal, an operating duration of the element to be driven that is driven by the driving sub-circuit according to the first data signal and the first power supply voltage signal is less than an operating duration of the element to be driven that is driven by the driving sub-circuit according to the second data signal and the first power supply voltage signal.

4. The pixel driving circuit according to claim 1, wherein a duration in which the data writing sub-circuit writes the first data signal into the driving sub-circuit and compensates for the threshold voltage of the driving transistor is equal to a duration in which the data writing sub-circuit writes the second data signal into the driving sub-circuit and compensates for the threshold voltage of the driving transistor.

5. The pixel driving circuit according to claim 1, wherein the driving sub-circuit further includes a capacitor;

a gate of the driving transistor is connected to a node, a first electrode of the driving to transistor is connected to the data writing sub-circuit and the control sub-circuit, and a second electrode of the driving transistor is connected to the data writing sub-circuit and the control sub-circuit; and an end of the capacitor is connected to the node, and another end of the capacitor is connected to the first power supply voltage signal terminal.

6. The pixel driving circuit according to claim 5, wherein the data writing sub-circuit includes a first data writing sub-circuit and a second data writing sub-circuit;

the first data writing sub-circuit is connected to the first scanning signal terminal, the third scanning signal terminal, the first data signal terminal, and the driving sub-circuit; and the first data writing sub-circuit is configured to, in response to the first scanning signal and the third scanning signal that are received, write the first data signal into the driving sub-circuit, and compensate for the threshold voltage of the driving transistor; and the second data writing sub-circuit is connected to the second scanning signal terminal, the third scanning signal terminal, the second data signal terminal, and the driving sub-circuit; and the second data writing sub-circuit is configured to, in response to the second scanning signal and the third scanning signal that are received, write the second data signal into the driving sub-circuit, and compensate for the threshold voltage of the driving transistor.

7. The pixel driving circuit according to claim 6, wherein the first data writing sub-circuit includes a second transistor and a third transistor;

a gate of the second transistor is connected to the first scanning signal terminal, a first electrode of the second transistor is connected to the first data signal terminal, and a second electrode of the second transistor is connected to the first electrode of the driving transistor; and a gate of the third transistor is connected to the third scanning signal terminal, a first electrode of the third transistor is connected to the second electrode of the driving transistor, and a second electrode of the third transistor is connected to the node.

8. The pixel driving circuit according to claim 6, wherein the second data writing sub-circuit includes a fourth transistor and a third transistor;

a gate of the fourth transistor is connected to the second scanning signal terminal, a first electrode of the fourth transistor is connected to the second data signal terminal, and a second electrode of the fourth transistor is connected to the first electrode of the driving transistor; and a gate of the third transistor is connected to the third scanning signal terminal, a first electrode of the third transistor is connected to the second electrode of the driving transistor, and a second electrode of the third transistor is connected to the node.

9. The pixel driving circuit according to claim 1, wherein the control sub-circuit includes a fifth transistor and a sixth transistor;

a gate of the fifth transistor is connected to the enable signal terminal, a first electrode of the fifth transistor is connected to the first power supply voltage signal terminal, and a second electrode of the fifth transistor is connected to the first electrode of the driving transistor; and a gate of the sixth transistor is connected to the enable signal terminal, a first electrode of the sixth transistor is connected to the second electrode of the driving transistor, and a second electrode of the sixth transistor is configured to be connected to to a first electrode of the element to be driven.

10. The pixel driving circuit according to claim 1, further comprising a reset sub-circuit, wherein the reset sub-circuit is connected to a first reset signal terminal, an initial voltage signal terminal and the driving sub-circuit; and the reset sub-circuit is configured to, in response to a first reset signal received from the first reset signal terminal, transmit an initial voltage signal provided from the initial voltage signal terminal to the driving sub-circuit.

11. The pixel driving circuit according to claim 10, wherein the reset sub-circuit includes a seventh transistor;

a gate of the seventh transistor is connected to the first reset signal terminal, a first electrode of the seventh transistor is connected to the initial voltage signal terminal, and a second electrode of the seventh transistor is connected to the driving sub-circuit.

12. The pixel driving circuit according to claim 10, wherein the reset sub-circuit is further connected to a second reset signal terminal; the reset sub-circuit is configured to be connected to the element to be driven; and the reset sub-circuit is further configured to, in response to a second reset signal received from the second reset signal terminal, transmit the initial voltage signal to the element to be driven.

13. A display device, comprising:

a display panel, including:

a plurality of pixel driving circuits according to claim 1; and a plurality of elements to be driven, each element to be driven being connected to a corresponding pixel driving circuit.

14. A driving method for the pixel driving circuit according to claim 1, comprising:

in a first phase, in response to the first scanning signal and the third scanning signal that are received, writing, by the data writing sub-circuit, the first data signal into the driving sub-circuit, and compensating, by the data writing sub-circuit, for the threshold voltage of the driving transistor;

in a second phase, in response to the enable signal that is received, connecting, by the control sub-circuit, the driving transistor to the first power supply voltage signal terminal, and connecting, by the control sub-circuit, the driving transistor to the element to be driven; and according to the first data signal and the first power supply voltage signal, outputting, by the driving sub-circuit, the driving signal to the element to be driven, so as to drive the element to be driven to operate;

in a third phase, in response to the second scanning signal and the third scanning signal that are received, writing, by the data writing sub-circuit, the second data signal into the driving sub-circuit, and compensating, by the data writing sub-circuit, for the threshold voltage of the driving transistor; and in a fourth phase, in response to the enable signal that is received, connecting, by the control sub-circuit, the driving transistor to the first power supply voltage signal terminal, and connecting, by the control sub-circuit, the driving transistor to the element to be driven; and according to the second data signal and the first power supply voltage signal, controlling, by the driving sub-circuit, the element to be driven to be in the operating state or in the non-operating state; wherein the second data signal is configured to cause the driving transistor to be turned on and in the saturation state, or cause the driving transistor to be turned off.

15. The driving method for the pixel driving circuit according to claim 14, wherein a duration of the fourth phase is greater than a duration of the second phase.

16. The driving method for the pixel driving circuit according to claim 14, wherein in a case where the second data signal is configured to cause the driving transistor to be turned on and in the saturation state, according to the second data signal and the first power supply voltage signal, controlling, by the driving sub-circuit, the element to be driven to be in the operating state or in the non-operating state includes:

according to the second data signal and the first power supply voltage signal, driving, by the driving sub-circuit, the element to be driven to operate.

17. The driving method for the pixel driving circuit according to claim 14, wherein in a case where the second data signal is configured to cause the driving transistor to be turned on and in the saturation state, an operating duration of the element to be driven that is driven by the driving sub-circuit according to the first data signal and the first power supply voltage signal is less than an operating duration of the element to be driven that is driven by the driving sub-circuit according to the second data signal and the first power supply voltage signal.

18. The driving method for the pixel driving circuit according to claim 14, wherein a duration in which the data writing sub-circuit writes the first data signal into the driving sub-circuit and compensates for the threshold voltage of the driving transistor is equal to a duration in which the data writing sub-circuit writes the second data signal into the driving sub-circuit and compensates for the threshold voltage of the driving transistor.

19. The driving method for the pixel driving circuit according to claim 14, wherein the pixel driving circuit further includes a reset sub-circuit, and the reset sub-circuit is connected to a first reset signal terminal, an initial voltage signal terminal, and the driving sub-circuit;

before the first phase, the driving method for the pixel driving circuit further comprises:

in a reset phase, in response to a first reset signal received from the first reset signal terminal, transmitting, by the reset sub-circuit, an initial voltage signal provided from the initial voltage signal terminal to the driving sub-circuit.

20. The driving method for the pixel driving circuit according to claim 19, wherein the reset sub-circuit is further connected to a second reset signal terminal and the element to be driven;

the driving method for the pixel driving circuit further comprises:

in the reset phase, in response to a second reset signal received from the second reset signal terminal, transmitting, by the reset sub-circuit, the initial voltage signal to the element to be driven.

* * * * *